US006979077B2

(12) United States Patent
Sakaida

(10) Patent No.: US 6,979,077 B2
(45) Date of Patent: Dec. 27, 2005

(54) INK-JET HEAD AND INK-JET PRINTER HAVING INK-JET HEAD

(75) Inventor: Atsuo Sakaida, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/367,789

(22) Filed: Feb. 19, 2003

(65) Prior Publication Data

US 2003/0156166 A1 Aug. 21, 2003

(30) Foreign Application Priority Data

Feb. 20, 2002 (JP) ..... 2002-043056

(51) Int. Cl.[7] ..... B41J 2/045
(52) U.S. Cl. ..... 347/68; 347/71
(58) Field of Search ..... 347/68, 70–72; 29/890.1

(56) References Cited

U.S. PATENT DOCUMENTS 5,128,694 A * 7/1992 Kanayama ..... 347/72
5,402,159 A 3/1995 Takahashi et al.
5,548,894 A 8/1996 Muto
6,109,736 A 8/2000 Miyata et al.
6,315,400 B1 * 11/2001 Sakai et al. ..... 347/70
6,431,691 B1 8/2002 Tanikawa et al.
6,550,897 B2 * 4/2003 Nakamura et al. ..... 347/68
6,575,565 B1 * 6/2003 Isono et al. ..... 347/71
2002/0003560 A1 1/2002 Isono et al.
2003/0156157 A1 8/2003 Suzuki et al.
2004/0041885 A1 3/2004 Hirota

FOREIGN PATENT DOCUMENTS

EP 0 401 996 A2 12/1990
EP 0 738 599 A2 10/1996
JP A 4-341852 11/1992

* cited by examiner

*Primary Examiner*—Stephen Meier
*Assistant Examiner*—An H. Do
(74) *Attorney, Agent, or Firm*—Oliff & Berridge, PLC

(57) ABSTRACT

An ink-jet head comprising a passage unit including pressure chambers having one end connected with a nozzle and the other end to be connected with an ink supply source, and an actuator unit fixed to a surface of the passage unit for changing the volume of each pressure chamber. The actuator unit is disposed to extend over the pressure chambers. In the passage unit, the pressure chambers are arranged along a plane to neighbor each other, wherein one nozzle communicates with two or more pressure chambers.

11 Claims, 13 Drawing Sheets

INK-JET HEAD AND INK-JET PRINTER HAVING INK-JET HEAD

BACKGROUND OF THE INVENTION

1. Field of Invention

The present invention relates to an ink-jet head for printing by ejecting ink onto a print medium, and to an ink-jet printer having the ink-jet head.

2. Description of Related Art

In an ink-jet printer, an ink-jet head distributes ink, which is supplied from an ink tank, to pressure chambers. The ink-jet head selectively applies pressure to each pressure chamber to eject ink through a nozzle. As a means for selectively applying pressure to the pressure chambers, an actuator unit may be used in which ceramic piezoelectric sheets are laminated.

As an example, the previously described ink-jet head is known to have one actuator unit in which continuous flat piezoelectric sheets extending over a plurality of pressure chambers are laminated. At least one of the piezoelectric sheets is sandwiched by an electrode common to many of the plurality of pressure chambers that is being kept at the ground potential, and many individual electrodes, i.e., driving electrodes, disposed at positions corresponding to the respective pressure chambers. The part of the piezoelectric sheet being sandwiched by the individual and common electrodes and polarized in its thickness, is expanded or contracted in its thickness direction as an active layer, by the so-called longitudinal piezoelectric effect, when a individual electrode on one face of the sheet is set at a different potential from the potential of the common electrode on the other face. Thereby, the volume of the corresponding pressure chamber changes, so ink can be ejected toward a print medium through a nozzle communicating with the pressure chamber.

Recently, in such an ink-jet head as described above, it has been strongly desired to drive the actuator unit with a low voltage in order to reduce power consumption and manufacturing cost. However, any existing ink-jet head, as described above, could not sufficiently meet the request.

SUMMARY OF THE INVENTION

An object of the present invention is to provide an ink-jet head whose actuator unit can be driven with a low voltage, and an ink-jet printer containing the ink-jet head.

According to the invention, an ink-jet head comprises a passage unit including pressure chambers each having one end connected to a nozzle and the other end to be connected with an ink supply source. The pressure chambers are arranged along a plane so as to neighbor each other. Two or more pressure chambers are connected to one nozzle. The ink-jet head further comprises an actuator unit fixed to a surface of the passage unit and extending over the pressure chambers for changing the volume of each of the pressure chambers.

According to the invention, one nozzle is connected to two or more pressure chambers. Therefore, by driving the actuator unit so that ink is simultaneously discharged from the pressure chambers into the nozzle, a sufficient amount of ink can be provided even when the driving voltage for the actuator unit is lowered. By lowering the driving voltage, reduction of the power consumption results. Furthermore, a small-size driver IC of a low manufacture cost can be used for driving the actuator unit. In the invention, when the number of pressure chambers that are connected to one nozzle is increased, the driving voltage is lowered. In addition, according to the invention, because the actuator unit is disposed to extend over the pressure chambers, manufacture is simplified.

BRIEF DESCRIPTION OF THE DRAWINGS

Various exemplary embodiments of the invention will be described in detail with reference to the following figures, wherein.

DETAILED DESCRIPTION OF PREFERRED EMBODIMENTS

Figure 1:
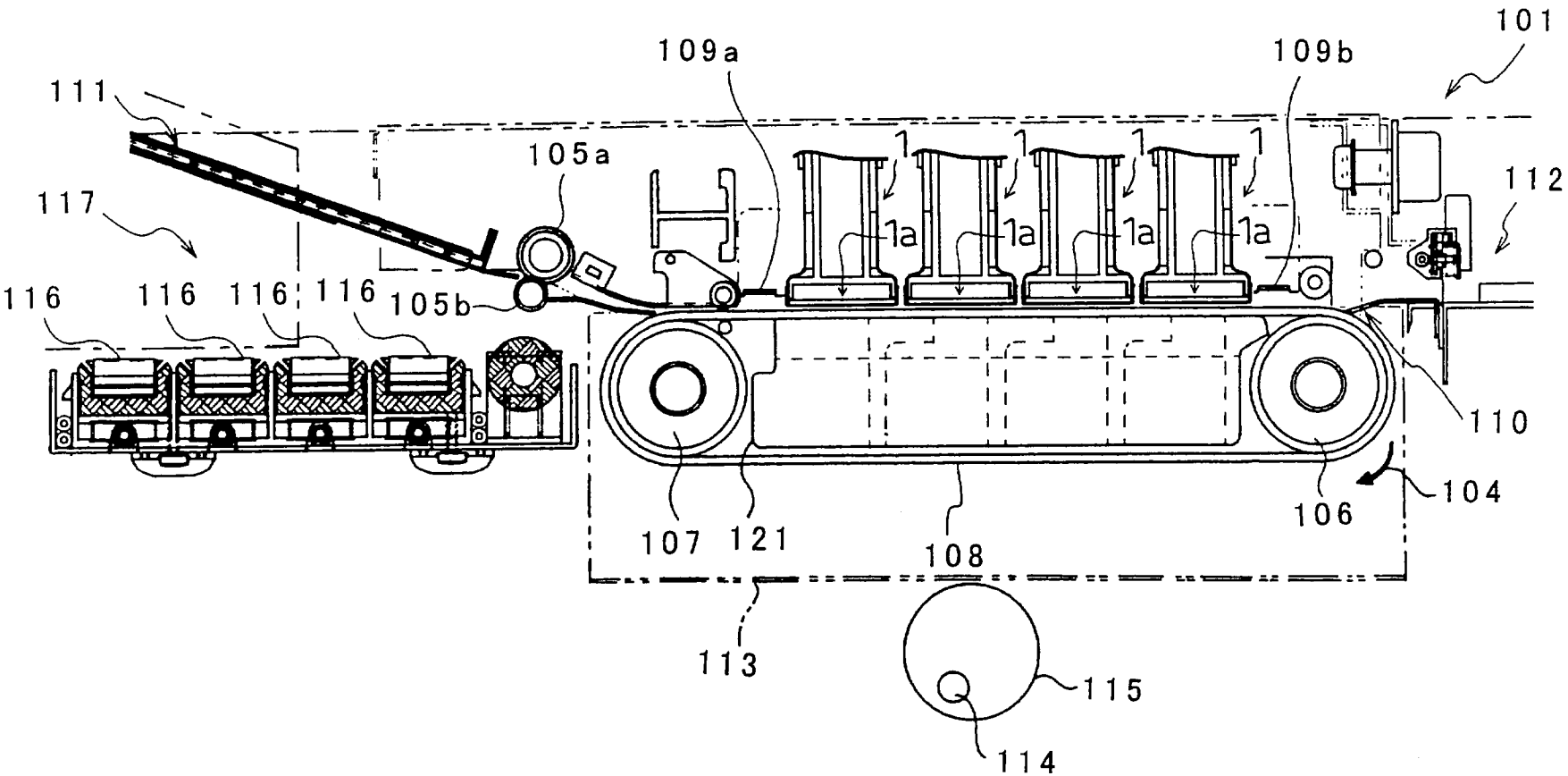
FIG. 1 is a general view of an ink-jet printer including ink-jet heads according to a first embodiment of the present invention.

FIG. 1 is a general view of an ink-jet printer including ink-jet heads according to a first embodiment of the invention. The ink-jet printer 101 as illustrated in FIG. 1 is a color ink-jet printer having four ink-jet heads 1. In the printer 101, a paper feed unit 111 and a paper discharge unit 112 are disposed in left and right portions of FIG. 1, respectively.

In the printer 101, a paper transfer path is provided extending from the paper feed unit 111 to the paper discharge unit 112. A pair of feed rollers 105*a* and 105*b* are disposed immediately downstream (rightward) of the paper feed unit 111 for pinching and advancing an image record medium, for example, a sheet of paper, card stock, photo paper, a transparency, or the like. The paper is transferred by the pair of feed rollers 105*a* and 105*b* from the left to the right in FIG. 1. In the middle of the paper transfer path, two belt rollers 106 and 107 and an endless transfer belt 108 are disposed. The transfer belt 108 is wound on the belt rollers 106 and 107 and extended between them. The outer face, i.e., the transfer face, of the transfer belt 108 has been treated with silicone. Thus, an image recording medium fed through the pair of feed rollers 105*a*, 105*b* can be held on the transfer face of the transfer belt 108 by the adhesion of the silicone treated face. In this state, the paper is transferred downstream by driving belt roller 106 to rotate clockwise in FIG. 1 (the direction indicated by an arrow 104).

Pressing members 109*a* and 109*b* are disposed at positions for feeding an image recording medium onto the belt roller 106 and extracting the image recording medium from the belt roller 106, respectively. Either of the pressing members 109*a* and 109*b* is for pressing the paper onto the transfer face of the transfer belt 108 so as to prevent the paper from separating from the transfer face of the transfer belt 108. Thus, the paper securely adheres to the transfer face.

A peeling device 110 is provided immediately downstream of the transfer belt 108 along the paper transfer path. The peeling device 110 peels off the paper, which has adhered to the transfer face of the transfer belt 108, from the transfer face to transport the paper toward the rightward paper discharge unit 112.

Each of the four ink-jet heads 1 has, at its lower end, a head main body 1*a*. Each head main body 1*a* has a rectangular section. The head main bodies 1*a* are arranged close to each other with the longitudinal axis of each head main body 1*a* being perpendicular to the paper transfer direction (perpendicular to FIG. 1). That is, printer 101 is a line type printer. The bottom of each of the four head main bodies 1*a* faces the paper transfer path. In the bottom of each head main body 1*a*, a number of nozzles are provided each having a small-diameter ink ejection port. The four head main bodies 1*a* eject ink of magenta, yellow, cyan, and black, respectively. However, various other embodiments of the invention are not limited by the above described colors or order.

The head main bodies 1*a* are disposed such that a narrow clearance must be formed between the lower face of each head main body 1*a* and the transfer face of the transfer belt 108. The image recording medium transfer path is formed within the narrow clearance. In this embodiment, while an image recording medium, which is being transferred by the transfer belt 108, passes immediately below the four head main bodies 1*a* in order, the inks are ejected through the corresponding nozzles toward the upper face, i.e., the print face, of the image recording medium to form a desired image on the image recording medium.

The ink-jet printer 101 is provided with a maintenance unit 117 for automatically carrying out maintenance of the ink-jet heads 1. The maintenance unit 117 includes four caps 116 for covering the lower faces of the four head main bodies 1*a*, and a purge system that is not illustrated.

The maintenance unit 117 is at a position immediately below the paper feed unit 117 (withdrawal position) while the ink-jet printer 101 operates to print. When a predetermined condition is satisfied after finishing the printing operation (for example, when a state in which no printing operation is performed continues for a predetermined time period or when the printer 101 is powered off), the maintenance unit 117 moves to a position immediately below the four head main bodies 1*a* (cap position), where the maintenance unit 117 covers the lower faces of the head main bodies 1*a* with the respective caps 116 to prevent the ink in the nozzles of the head main bodies 1*a* from being dried.

The belt rollers 106 and 107 and the transfer belt 108 are supported by a chassis 113. The chassis 113 is set on a cylindrical member 115 disposed under the chassis 113. The cylindrical member 115 is rotatable around a shaft 114 provided at a position deviating from the center of the cylindrical member 115. Thus, by rotating the shaft 114, the level of the uppermost portion of the cylindrical member 115 can be changed to move the chassis 113 up or down accordingly. When the maintenance unit 117 is moved from the withdrawal position to the cap position, the cylindrical member 115 will have been rotated at a predetermined angle in advance so as to move the transfer belt 108 and the belt rollers 106 and 107 down by a distance from the position illustrated in FIG. 1, thereby creating a space for the movement of the maintenance unit 117.

In the region surrounded by the transfer belt 108, a nearly rectangular guide 121 (having its width substantially equal to that of the transfer belt 108) is disposed at a position opposite to the ink-jet heads 1. The guide 121 is in contact with the lower face of the upper part of the transfer belt 108 to support the upper part of the transfer belt 108 from the inside.

Figure 2:
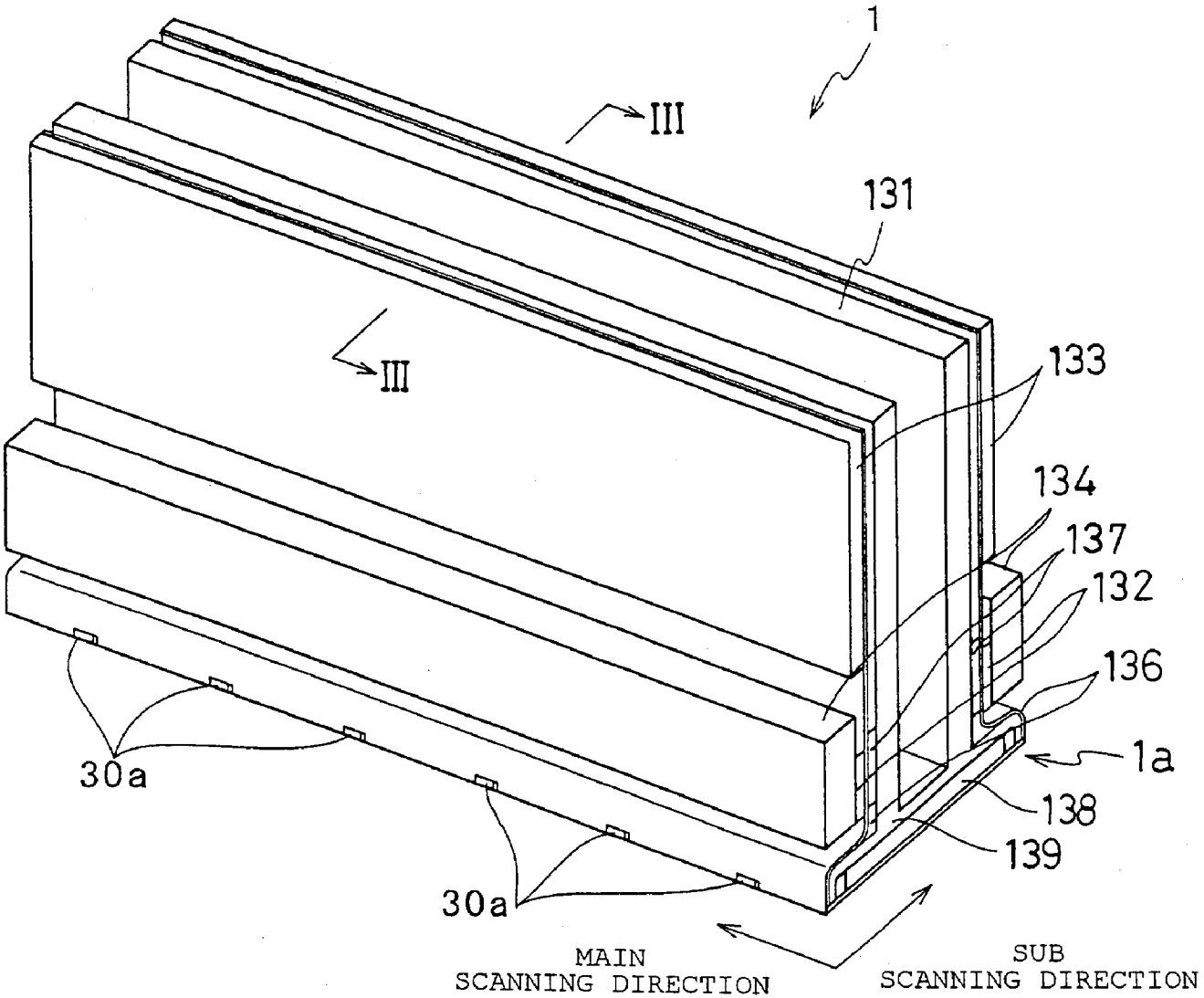
FIG. 2 is a perspective view of an ink-jet head according to the first embodiment of the present invention.
Figure 3:
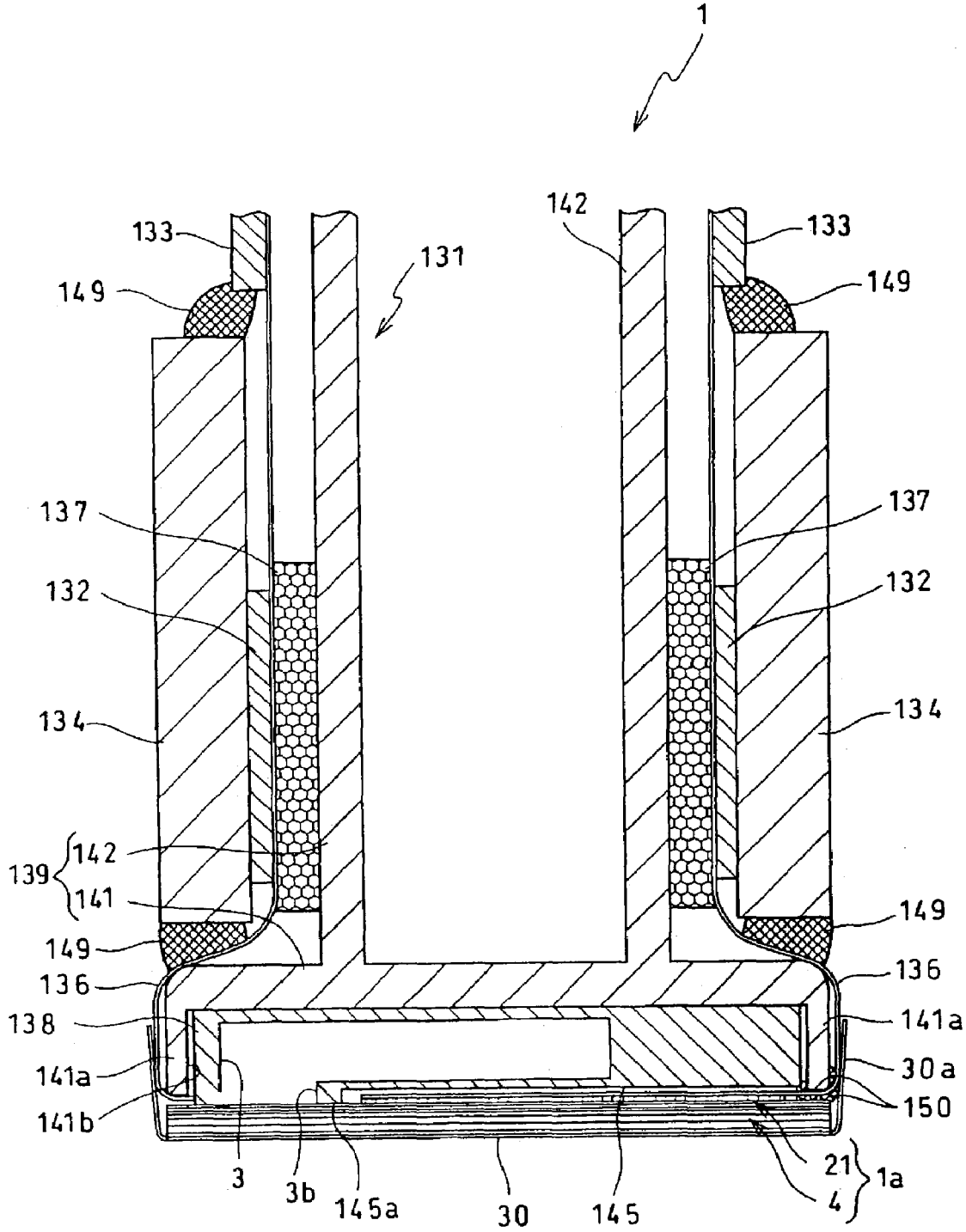
FIG. 3 is a sectional view taken along line III—III in FIG. 2.

Referring to FIGS. 2 and 3, the construction of each ink-jet head 1 according to this embodiment will be described in more detail. The ink-jet head 1 according to this embodiment includes a head main body 1*a* having a rectangular shape in a plan view with its longest side extending in the main scanning direction, and a base portion 131 for supporting the head main body 1*a*. The base portion 131 supporting the head main body 1*a* further supports driver ICs 132 for supplying driving signals to individual electrodes 35 (see FIG. 6), and substrates 133.

Referring to FIG. 2, the base portion 131 is made up of a base block 138 partially bonded to the upper face of the head main body 1*a* to support the head main body 1*a*, and a holder 139 bonded to the upper face of the base block 138 to support the base block 138. The base block 138 is a nearly rectangular member having substantially the same length as the head main body 1*a*. The base block 138 made of metal material, such as stainless steel, is a light structure for reinforcing the holder 139. The holder 139 comprises a holder main body 141 disposed near the head main body 1*a*, and a pair of holder support portions 142 each extending on the opposite side of the holder main body 141 from the head main body 1*a*. Each holder support portion 142 is as a flat member. These holder support portions 142 extend along the longitudinal direction of the holder main body 141 and are disposed substantially parallel to each other at a predetermined interval.

Skirt portions 141*a* in a pair, protruding downward, are provided in both end portions of the holder main body 141*a* when viewed in a plane perpendicular to the main scanning direction. Each skirt portion 141*a* is formed through the length of the holder main body 141. As a result, in the lower portion of the holder main body 141, a nearly rectangular groove 141*b* is defined by the pair of skirt portions 141*a*. The base block 138 is received in the groove 141*b*. The upper surface of the base block 138 is bonded to the bottom of the groove 141*b* of the holder main body 141 with an adhesive. The thickness of the base block 138 is somewhat larger than the depth of the groove 141*b* of the holder main body 141. As a result, the lower end of the base block 138 protrudes downward beyond the skirt portions 141*a*.

Within the base block 138, as a passage for ink to be supplied to the head main body 1*a*, an ink reservoir 3 is formed as a nearly rectangular space (hollow region) extending along the longitudinal direction of the base block 138. In the lower face 145 of the base block 138, openings 3*b* (see FIG. 4) are formed each communicating with the ink reservoir 3. The ink reservoir 3 is connected through a non-illustrated supply tube with a non-illustrated main ink tank (ink supply source) within the printer main body. Thus, the ink reservoir 3 is suitably supplied with ink from the main ink tank.

In the lower face 145 of the base block 138, the vicinity portion 145*a* of each opening 3*b* protrudes downward from the surrounding portion. The base block 138 is in contact with a passage unit 4 (see FIG. 3) of the head main body 1*a* only at the vicinity portion 145*a* of each opening 3*b* of the lower face 145. Thus, the region of the lower face 145 of the base block 138 other than the vicinity portion 145*a* of each opening 3*b* is distant from the head main body 1*a*. Actuator units 21 are disposed within the distance.

A driver IC 132 is fixed to the outside face of each holder support portion 142 of the holder 139 with an elastic member 137, such as a sponge being interposed between them. A heat sink 134 is disposed in close contact with the outside face of the driver IC 132. The heat sink 134 is made of a nearly rectangular member for efficiently radiating heat generated in the driver IC 132. As a power supply, a flexible printed circuit (FPC) 136 is connected to the driver IC 132. The FPC 136 connected to the driver IC 132 is bonded to and electrically connected with the corresponding substrate 133 and the head main body 1*a* by soldering. The substrate 133 is disposed outside the FPC 136 above the driver IC 132 and the heat sink 134. The upper face of the heat sink 134 is bonded to the substrate 133 with a seal member 149. Also, the lower face of the heat sink 134 is bonded to the FPC 136 with a seal member 149.

Between the lower face of each skirt portion 141*a* of the holder main body 141 and the upper face of the passage unit 4, a seal member 150 is disposed to sandwich the FPC 136. The FPC 136 is fixed by the seal member 150 to the passage unit 4 and the holder main body 141. Therefore, even if the head main body 1*a* is elongated, the head main body 1*a* can be prevented from being bent, the interconnecting portion between each actuator unit and the FPC 136 can be prevented from receiving stress, and the FPC 136 can be held securely.

Referring to FIG. 2, in the vicinity of each lower corner of the ink-jet head 1 along the main scanning direction, six protruding portions 30*a* are disposed at regular intervals along the corresponding side wall of the ink-jet head 1. These protruding portions 30*a* are provided at both ends in a nozzle plate 30 in the lowermost layer of the head main body 1*a* as viewed in a plane parallel in the main scanning direction (see FIGS. 7A and 7B). The nozzle plate 30 is bent by about 90 degrees along the boundary line between each protruding portion 30*a* and the other portion. The protruding portions 30*a* are provided at positions corresponding to the vicinities of both ends of various sized image recording mediums to be used for printing. Each bent portion of the nozzle plate 30 has a shape, not right-angled, but rounded. This makes it less likely to bring about clogging of an image recording medium, i.e., jamming, which may occur because the leading edge of the image recording medium, which has been transferred to approach the head 1, is stopped by the side face of the head 1.

Figure 4:
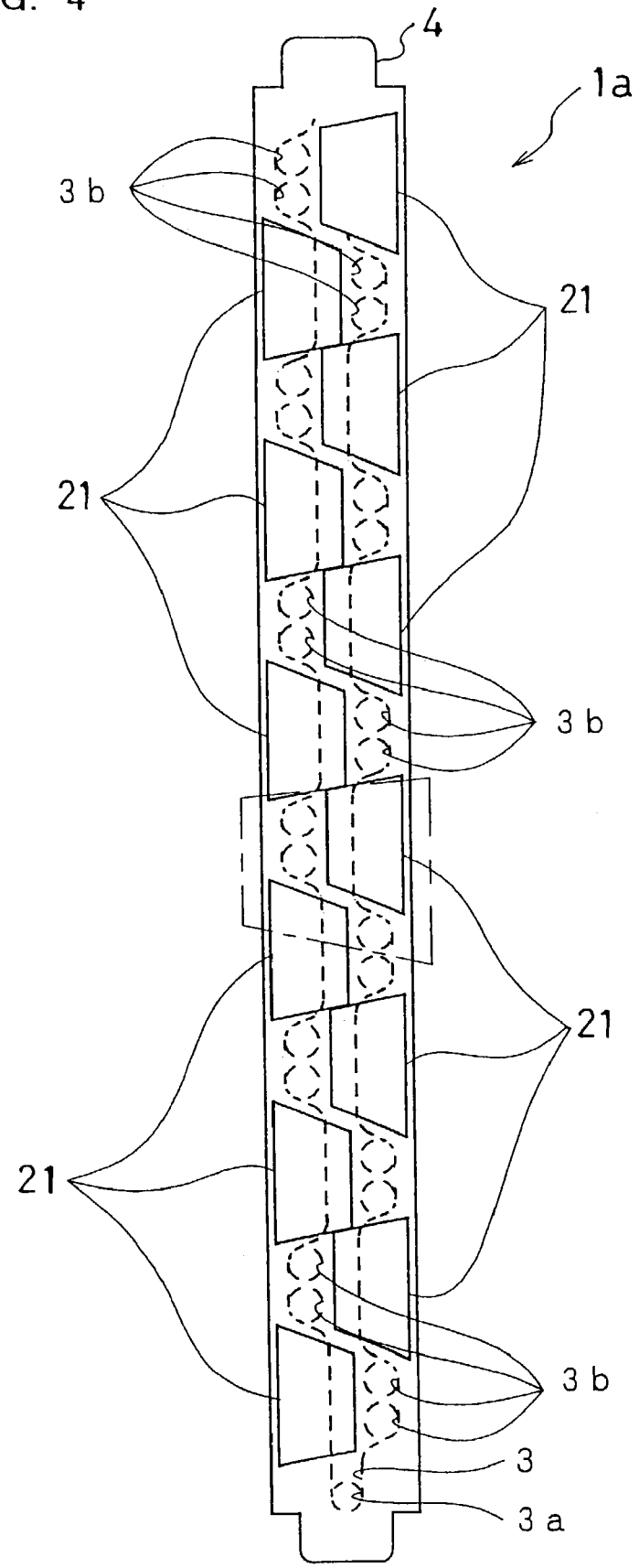
FIG. 4 is a plan view of a head main body included in the ink-jet head of FIG. 2.

FIG. 4 is a schematic plan view of the head main body 1*a*. In FIG. 4, an ink reservoir 3 formed in the base block 138 is illustrated with a broken line. As illustrated in FIG. 4, the head main body 1*a* has a rectangular shape in the plan view with the longer side extending in one direction (main scanning direction). The head main body 1*a* includes a passage unit 4 in which a large number of pressure chambers 10 and a large number of ink ejection ports 8 at the front ends of nozzles (as for both, see FIGS. 5, 6, 7A, and 7B), as described later. Trapezoidal actuator units 21 arranged in two lines in a zigzag manner are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 4 is made into an ink ejection region. In the surface of each ink ejection region, a large number of ink ejection ports 8 are arranged in a matrix, as described later. In the base block 138 disposed above the passage unit 4, an ink reservoir 3 is formed along the longitudinal direction of the base block 138. The ink reservoir 3 communicates with an ink tank (not illustrated) through an opening 3*a* provided at one end of the ink reservoir 3, so that the ink reservoir 3 is always filled with ink. In the ink reservoir 3, pairs of openings 3*b* are provided in regions where no actuator unit 21 is present, so as to be arranged in a zigzag manner along the longitudinal direction of the ink reservoir 3.

Figure 5:
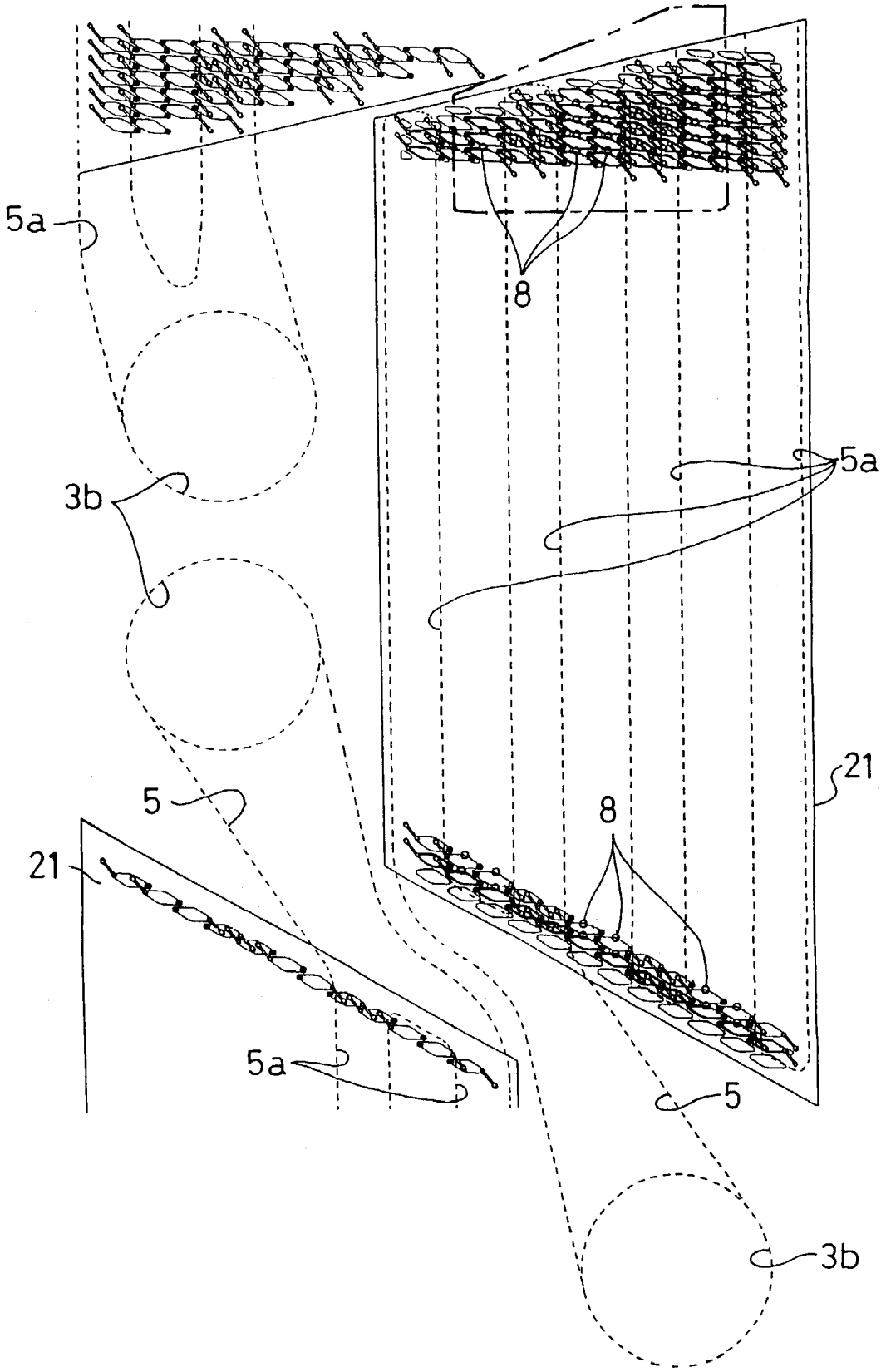
FIG. 5 is an enlarged view of the region enclosed with an alternating long and short dash line in FIG. 4.

FIG. 5 is an enlarged view of the region enclosed with an alternate long and short dash line in FIG. 4. Referring to FIGS. 4 and 5, the ink reservoir 3 communicates through each opening 3*b* with a manifold channel 5 disposed under the opening 3*b*. Each opening 3*b* is provided with a filter (not illustrated) for catching dust and dirt contained in ink. The front end portion of each manifold channel 5 branches into two sub-manifold channels 5*a*. Below a single one of the actuator units 21, two sub-manifold channels 5*a* extend from each of the two openings 3*b* on both sides of the actuator unit 21 in the longitudinal direction of the ink-jet head 1. That is, below the single actuator unit 21, four sub-manifold channels 5*a* in total extend along the longitudinal direction of the ink-jet head 1. Each sub-manifold channel 5*a* is filled with ink supplied from the ink reservoir 3.

Figure 6:
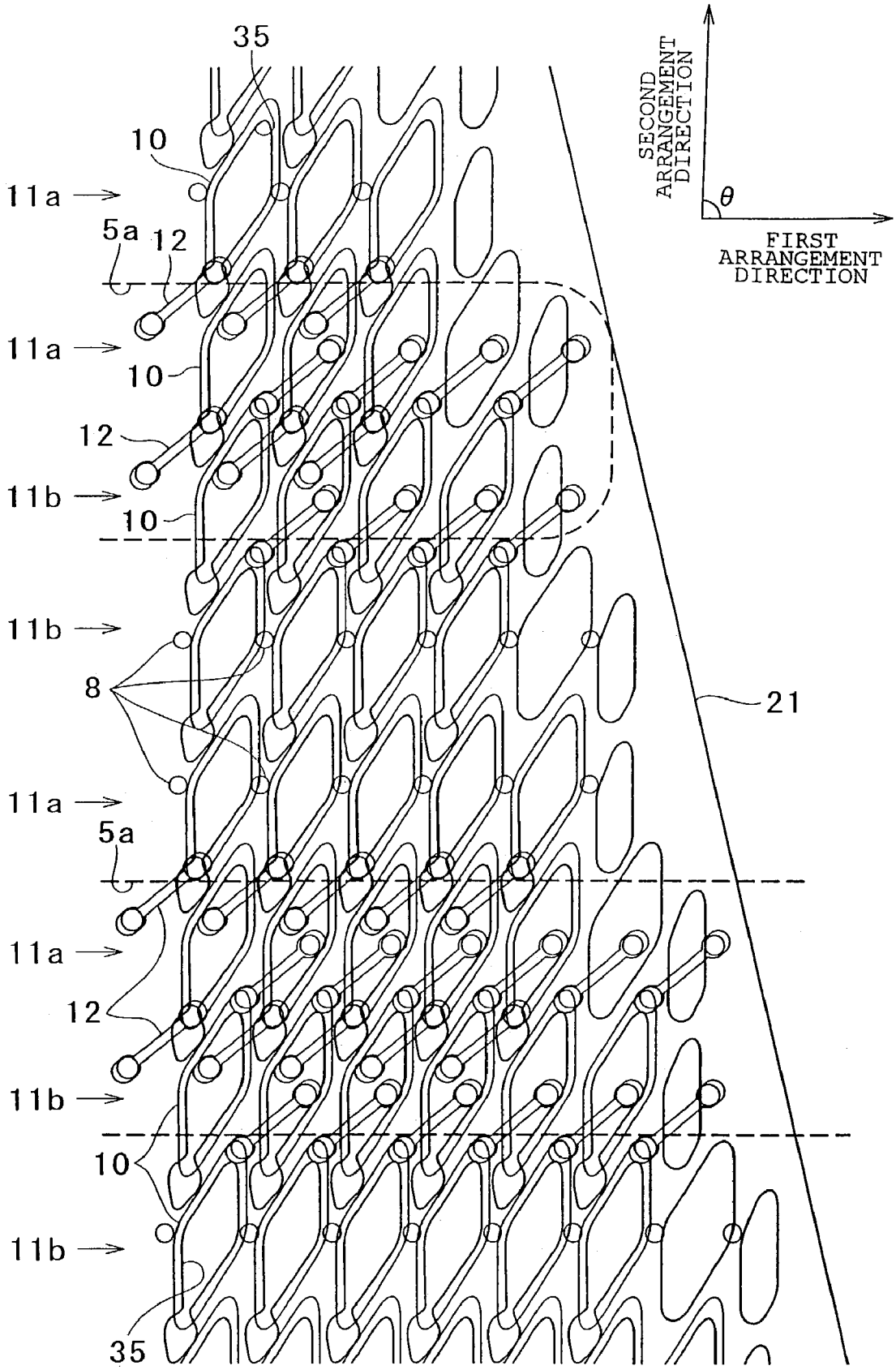
FIG. 6 is an enlarged view of the region enclosed with an alternating long and short dash line in FIG. 5.

FIG. 6 is an enlarged view of the region enclosed with an alternate long and short dash line in FIG. 5. Referring to FIGS. 5 and 6, individual electrodes 35 each having a nearly rhombic shape in a plan view are regularly arranged in a matrix on the upper face of an actuator unit 21. A large number of ink ejection ports 8 are regularly arranged in a matrix in the surface of the ink ejection region of the passage unit 4 corresponding to the actuator unit 21. Within the passage unit 4, pressure chambers (cavities) 10, each having a nearly rhombic shape in a plan view, somewhat larger than that of an individual electrode 35, and communicating with the corresponding ink ejection port 8 are regularly arranged in a matrix. Also, apertures 12, each communicating with the corresponding ink ejection port 8, are regularly arranged in a matrix. The pressure chambers 10 are formed at positions corresponding to the respective individual electrodes 35. The large part of each individual electrode 35 is included in a region corresponding to a pressure chamber 10 in a plan view. In FIGS. 5 and 6, for the purpose of making it easy to understand the drawings, pressure chambers 10, apertures 12, etc., are illustrated with solid lines, though they should be illustrated with broken lines because they are within the actuator unit 21 or the passage unit 4.

Figure 7A:
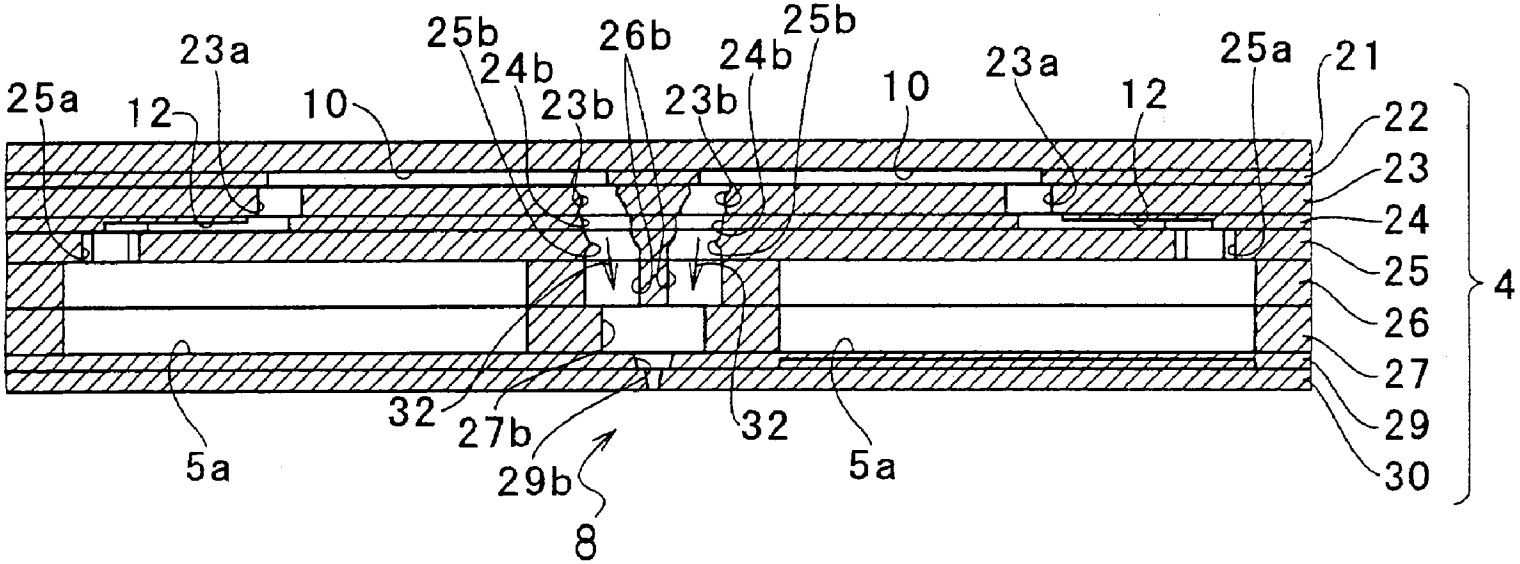
FIG. 7A is a partial sectional view of the head main body of FIG. 4.
Figure 7B:
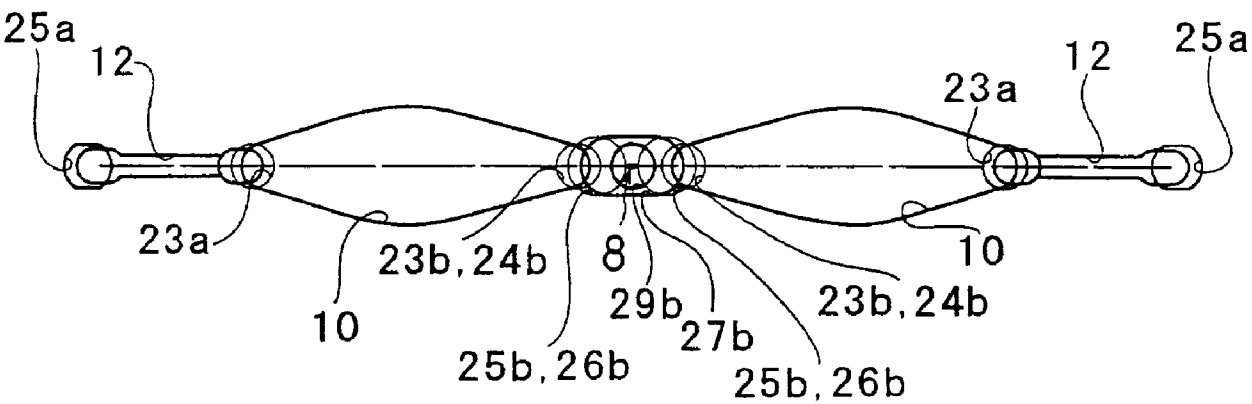
FIG. 7B is a see-through plan view of a principal portion of the head main body of FIG. 4.

FIG. 7A is a partial sectional view of the head main body illustrated in FIG. 4. FIG. 7B is a see-through plan view of a principal portion of the head main body illustrated in FIG. 4. Referring to FIGS. 7A and 7B, each ink ejection port 8 is disposed where no sub-manifold channel 5*a* is present. The ink ejection port 8 is formed into a tapered nozzle provided between two pressure chambers 10 neighboring each other along the longer diagonal of each substantially rhombic pressure chamber 10 (hereinafter, referred to as diagonal direction). The inner space of the ink ejection port 8 branches at its upper part into two branches. Each branch is connected to a sub-manifold channel 5*a* through a pressure chamber 10 having a rhombic shape in a plan view (length: 900 μm, width: 350 μm) and an aperture 12. That is, one ink ejection port 8 communicates with two pressure chambers 10. Thus, in the ink-jet head 1, ink passages 32 are formed each extending from the ink tank to an ink ejection port 8 through the ink reservoir 3, two manifold channels 5, two sub-manifold channels 5*a*, two apertures 12, and two pressure chambers 10. Two ink flows, which have discharged from the respective pressure chambers 10 through the ink passage 32, join in the upper part of the ink ejection port 8 to be ejected through the ink ejection port 8.

Next, the arrangement of pressure chambers 10, sub-manifold channels 5*a*, etc., disposed in the trapezoidal ink ejection region illustrated in FIG. 5 will be described with reference to FIG. 6. Pressure chambers 10 are arranged in the trapezoidal ink ejection region in two directions, i.e., in a direction along the longitudinal direction of the ink-jet head 1 (the first arrangement direction) and in a direction somewhat inclined to the lateral direction of the ink-jet head 1 (the second arrangement direction). The first and second arrangement directions form an angle θ somewhat smaller than a right angle.

In the matrix of the pressure chambers 10 formed in the upper face of the passage unit 4, there are pressure chamber rows each constituted by pressure chambers arranged along the first arrangement direction illustrated in FIG. 6. There are two kinds of pressure chamber rows, i.e., the first and second pressure chamber rows, in accordance with the dispositions of the ink ejection ports 8.

In the first pressure chamber row 11*a*, each ink ejection port 8 is present on one side of the corresponding pressure chamber 10 with respect to the line crossing the first arrangement direction and interconnecting both ends of the pressure chamber 10, i.e., the longer diagonal of the pressure chamber 10, when viewed perpendicularly to FIG. 6. That is, the ink ejection port 8 is present on the upper side of the pressure chamber 10 in FIG. 6 in this embodiment.

Alternatively, in the second pressure chamber row 11*b*, each ink ejection port 8 is present on the other side of the corresponding pressure chamber 10 with respect to the longer diagonal of the pressure chamber 10, i.e., on the lower side of the pressure chamber 10 in FIG. 6. Two first pressure chamber rows 11*a* and two second pressure chamber rows 11*b* are arranged alternately.

Therefore, an ink ejection port 8 communicating with a pressure chamber 10 belonging to a first pressure chamber row 11*a* also communicates with a pressure chamber 10 belonging to the second pressure chamber row 11*b*, two rows above from the first pressure chamber row 11*a*. The ink ejection port 8 is in between those pressure chambers 10 at a distance from the pressure chambers 10.

Each sub-manifold channel 5*a* extending along the first arrangement direction, as a common ink passage, communicates with pressure chambers 10. In order that the ink ejection port 8 connected with each pressure chamber 10 faces outward when viewed perpendicularly to FIG. 6, each sub-manifold channel 5*a* is disposed so as to include the boundary region between one first pressure chamber row 11*a* and one second pressure chamber row 11*b* neighboring each other and not to overlap any ink ejection port 8. Such a sub-manifold channel 5*a* preferably includes most of the respective pressure chambers 11*a* and 11*b* neighboring each other so that the sub-manifold channel 5*a* can have a wide width. Because the sub-manifold channel 5*a* does not overlap any ink ejection ports 8, the limit of the width of the sub-manifold channel 5*a* is preferably set within the vicinity of one end of each pressure chamber connected with the ink ejection port 8.

Referring to FIG. 7A, each aperture 12, connecting a pressure chamber 10 with a sub-manifold channel 5*a*, extends substantially parallel to the surface of the passage unit 4. The aperture 12 gives proper resistance to the corresponding ink passage in order to stabilize ink ejection. The pressure chamber 10 and the aperture 12 are provided at different levels. Therefore, in the portion of the passage unit 4 corresponding to the ink ejection region under an actuator unit 21, an aperture 12 connected to one pressure chamber 10 can be disposed within the same portion in plan view as a second pressure chamber 10 neighboring the pressure chamber 10 communicating with the aperture 12. As a result, since pressure chambers 10 can be arranged close to each other and at a high density, image printing at a high resolution can be realized with an ink-jet head 1 occupying a relatively small area.

In a pressure chamber 10, the propagation direction of a pressure wave used for ejecting ink (hereinafter, simply referred to as pressure wave propagation direction) is substantially in parallel with the line interconnecting both ends of the pressure chamber 10, i.e., the longer diagonal of the pressure chamber 10. Typically, when the pressure wave propagation direction is perpendicular to the surface, the pressure chamber 10 is generally formed into a symmetrical shape such as a circle or an equilateral polygon in a plan view. However, when the pressure chamber 10 has a long and narrow shape such as a rhombus and the pressure wave propagation direction is along the longer diagonal of the pressure chamber 10, along the surface, the acoustic length (the time for which a pressure wave propagates one way in the pressure chamber 10) of the actuator unit is relatively long. Therefore, when the so-called fill-before-fire (a method in which a voltage is applied in advance to all individual electrodes 35 to decrease the volumes of all pressure chambers 10, then the voltage is relieved from the individual electrode 35 of the only pressure chamber that is to operate for ink ejection and thereby the volume of the pressure chamber is increased, and then the voltage is again applied to the individual electrode 35 to decrease the volume of the pressure chamber 10, thereby efficiently applying ejecting pressure to the ink using a pressure wave propagating in the pressure chamber 10) is performed, the driving clock frequency for the individual electrodes 35 may be lowered, and thus controlling driving voltage is easy.

The pressure chambers 10 and the ink ejection ports 8 are arranged at 50 dpi in the first arrangement direction. On the other hand, the pressure chambers 10 are arranged in the second arrangement direction such that one ink ejection region includes twelve pressure chambers 10 (six ink ejection ports 8). Therefore, within the whole width of the ink-jet head 1, in a region of the interval between two ink ejection ports 8 neighboring each other in the first arrangement direction, there are six ink ejection ports 8. At both ends of each ink ejection region in the first arrangement direction (corresponding to an oblique side of the actuator unit 21), the above condition is satisfied by making a compensation relation to the opposite ink ejection region in the lateral direction of the ink-jet head 1. Therefore, in the ink-jet head 1 according to this embodiment, by ejecting ink droplets in order through a large number of ink ejection ports 8 arranged in the first and second directions with relative movement of an image recording medium along the lateral direction of the ink-jet head 1, printing at 300 dpi in the main scanning direction can be performed.

Figure 8:
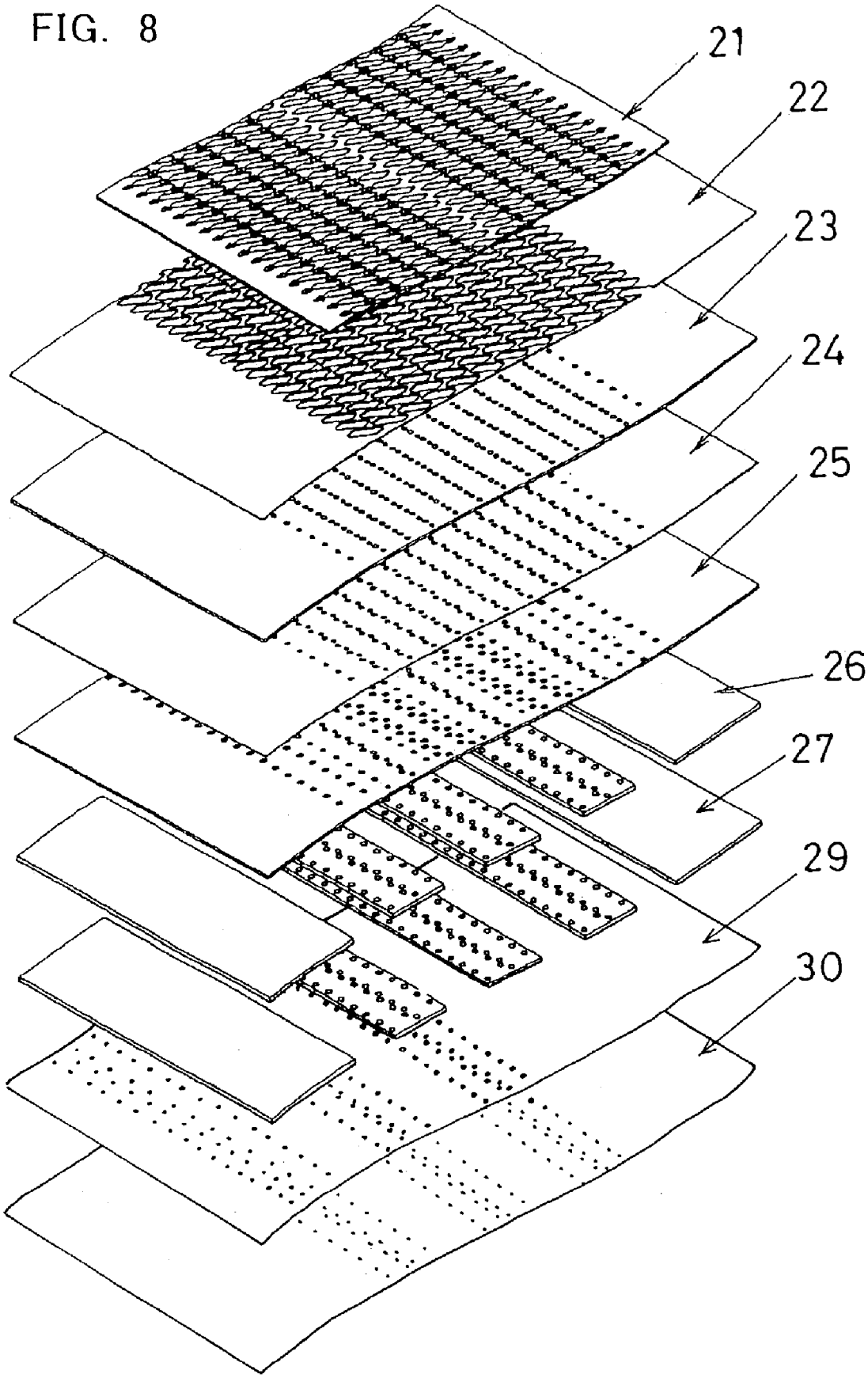
FIG. 8 is a partial exploded view of the head main body of FIG. 4.

Referring to FIGS. 7A and 8, the sectional construction of the ink-jet head 1 according to this embodiment will be described. FIG. 8 is a partial exploded view of the head main body 1*a* illustrated in FIG. 4. A principal portion on the bottom side of the ink-jet head 1 has a layered structure laminated with nine sheet materials in total, i.e., from the top, an actuator unit 21, a cavity plate 22, a base plate 23, an aperture plate 24, a supply plate 25, manifold plates 26 and 27, a cover plate 29, and a nozzle plate 30. Of them, eight plates other than the actuator unit 21 constitute a passage unit 4. Each of the eight plates 22 to 30 constituting the passage unit 4 may be laminated with sheet members.

As described later in detail, the actuator unit 21 is laminated with four piezoelectric sheets and provided with electrodes so that only its uppermost layer includes active portions when a voltage is applied (hereinafter, simply referred to as "layer including active layers (active portions) "), and the remaining three layers are inactive.

The cavity plate 22 is made of metal, in which a large number of substantially rhombic openings are formed corresponding to the respective pressure chambers 10. Referring to FIGS. 7A and 7B, the base plate 23 is made of metal, in which a communication hole 23*a* between each pressure chamber 10 of the cavity plate 22 and an aperture 12, and a communication hole 23*b* between the pressure chamber 10 and an ink ejection port 8 are formed.

The aperture plate 24 is made of metal, in which a communication hole 24*b*, continuous from the communication hole 23*b*, to communicate with an ink ejection port 8 is formed for each pressure chamber 10 of the cavity plate 22, in addition to the aperture 12 for the pressure chamber 10. The supply plate 25 is made of metal, in which a communication hole 25*a* between the aperture 12 and the sub-manifold channel 5*a* and a communication hole 25*b*, continuous from the communication holes 23*b* and 24*b*, to communicate with an ink ejection port 8 are formed corresponding to each pressure chamber 10 of the cavity plate 22.

The manifold plate 26 is made of metal, which defines an upper portion of each sub-manifold channel 5*a* and in which a communication hole 26*b*, continuous from the communication holes 23*b*, 24*b*, and 25*b*, to communicate with an ink ejection port 8 is formed to correspond to each pressure chamber 10 of the cavity plate 22. The manifold plate 27 is made of metal, which defines the lower wall of each sub-manifold channel 5*a* and in which a communication hole 27*b*, continuous from the two communication holes 26*b*, is formed corresponding to each of the two pressure chambers 10 neighboring each other along their longer diagonals. The two communication holes 26*b* communicate with the respective pressure chambers 10.

The cover plate 29 is made of metal, in which a communication hole 29*b*, continuous from the communication holes 23*b*, 24*b*, 25*b*, 25*b*, and 27*b*, to communicate with an ink ejection port 8 is formed corresponding to each two pressure chambers 10, neighboring each other along their longer diagonals. The nozzle plate 30 is made of metal, in which a tapered ink ejection port 8, to function as a nozzle communicating with two pressure chambers through the communication holes 23*b*, 24*b*, 25*b*, 26*b*, 27*b*, and 29*b*, is formed corresponding to each two pressure chambers 10, neighboring each other along their longer diagonals.

The nine sheets 21 to 30 are put in layers positioned adjacent to each other in order to form an ink passage 32 as illustrated in FIG. 7A. The ink passage 32 first extends upward from the sub-manifold channel 5*a*, then extends horizontally in the aperture 12, then further extends upward, then again extends horizontally in the pressure chamber 10, then extends obliquely downward in a certain length angling away from the aperture 12, and then extends vertically downward. Two such passages from two pressure chambers 10, neighboring each other along their longer diagonals, join within the communication hole 27*a* to reach the ink ejection port 8.

In this embodiment, six plates other than the cavity plate 22 and the nozzle plate 30, i.e., the base plate 23, the aperture plate 24, the supply plate 25, the manifold plates 26 and 27, and the cover plate 29 construct a connection plate in which a connection passage is formed by the communication holes 23*b*, 24*b*, 25*b*, 26*b*, 27*b*, and 29*b*.

Figure 9:
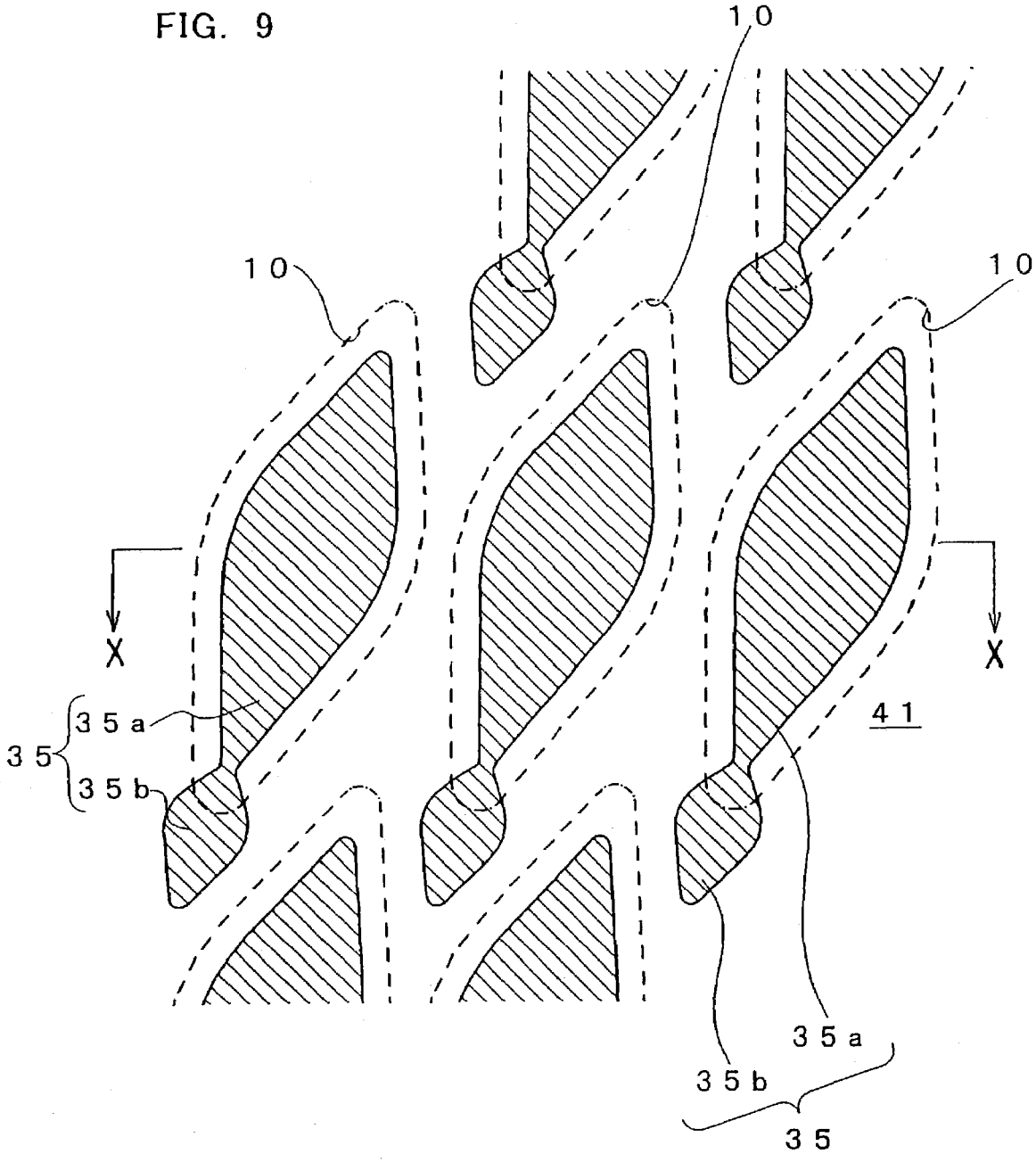
FIG. 9 is a partial enlarged schematic plan view of FIG. 6.

Referring to FIG. 9, the detailed construction of each actuator unit 21 will be described. FIG. 9 is a partial enlarged schematic plan view of FIG. 6. An individual electrode 35, about 1.1 μm-thick, is provided on the upper surface of the actuator unit 21 at a position substantially overlapping each pressure chamber 10 in a plan view. The individual electrode 35 is made up of a substantially rhombic main electrode portion 35*a* and a substantially rhombic auxiliary electrode portion 35*b* formed, continuously from one acute portion of the main electrode portion 35*a*, to be smaller than the main electrode portion 35*a*. The main electrode portion 35*a* has a similar shape to that of the pressure chamber 10 and is smaller than the pressure chamber 10. The main electrode portion 35*a* is disposed so as to be included within the pressure chamber 10 in a plan view. Alternatively, most of the auxiliary electrode portion 35*b* is outside of the pressure chamber 10 in the plan view. In the region of the upper face of the actuator unit 21 other than the individual electrodes 35, a piezoelectric sheet 41 as described later is exposed.

Figure 10:
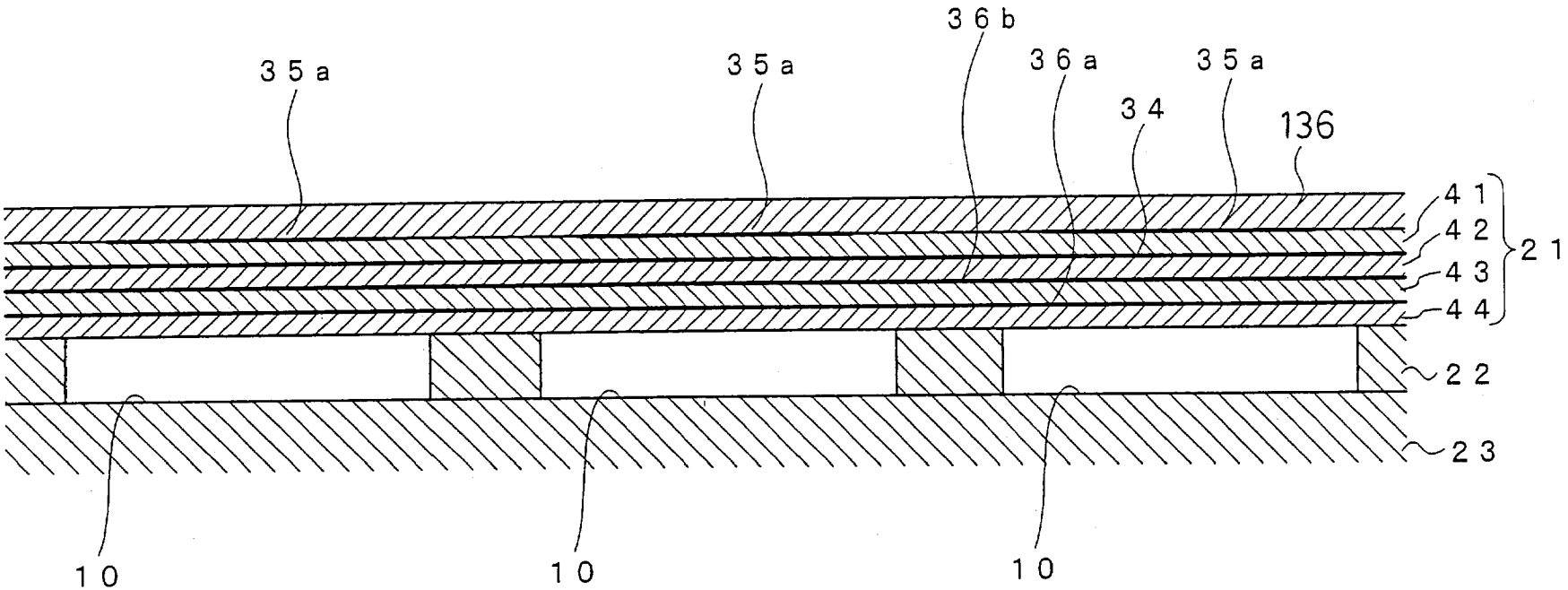
FIG. 10 is a sectional view taken along line X—X of FIG. 9.

FIG. 10 is a sectional view taken along line X—X of FIG. 9. Referring to FIG. 9, the actuator unit 21 includes four piezoelectric sheets 41, 42, 43, and 44 having the same thickness, of about 15 μm. An FPC 136 is bonded to the upper face of the actuator unit 21 for supplying signals for controlling the potentials of each individual electrode 35 and the common electrode 34. The piezoelectric sheets 41 to 44 are made into a continuous layered flat plate (continuous flat layers) that is disposed so as to extend over many pressure chambers 10 formed within one ink ejection region in the ink-jet head 1. Because the piezoelectric sheets 41 to 45 are disposed so as to extend over many pressure chambers 10 as the continuous flat layers, the individual electrodes 35 can be arranged at a high density, e.g., by using a screen printing technique. Therefore, the pressure chambers 10 formed at positions corresponding to the respective individual electrodes 35 can be arranged at a high density. This makes it possible to print a high-resolution image. In this embodiment, each of the piezoelectric sheets 41 to 44 is made of a lead zirconate titanate (PZT)-base ceramic material having ferroelectricity.

Between the uppermost piezoelectric sheet 41 and the piezoelectric sheet 42, neighboring the piezoelectric sheet 41, an about 2 μm-thick common electrode 34 is formed on the whole of the lower face of the piezoelectric sheet 41. Furthermore, as described above, on the upper face of the actuator unit 21, i.e., the upper face of the piezoelectric sheet 41, the individual electrodes 35 are formed to correspond to the respective pressure chambers 10.

Each individual electrode 35 is made up of a main electrode portion 35*a* having a similar shape (length: 850 μm, width: 250 μm) to each pressure chamber 10 in a plan view and a substantially rhombic auxiliary electrode portion 35*b*. The image of the main electrode portion 35*a*, projected along its thickness, is included within the corresponding pressure chamber 10. Further, reinforcement metallic films 36*a* and 36*b* for reinforcing the actuator unit 21 are interposed between the piezoelectric sheets 43 and 44 and between the piezoelectric sheets 42 and 43, respectively. Each of the reinforcement metallic films 36*a* and 36*b*, formed on substantially the whole area of the piezoelectric sheet 41, similar to the common electrode 34, has substantially the same thickness as the common electrode 34. In this embodiment, each individual electrode 35 is made of a layered metallic material in which Ni (thickness: about 1 μm) and Au (thickness: about 0.1 μm) are formed as the lower and upper layers, respectively. Each of the common electrodes 34 and the reinforcement metallic films 36*a* and 36*b* are made of, for example, an Ag—Pd-base metallic material. The reinforcement metallic films 36*a* and 36*b* do not function as electrodes so they are not always required. But, by providing the reinforcement metallic films 36*a* and 36*b*, brittleness of the piezoelectric sheets 41 to 44 after sintering can be reduced. As a result, the piezoelectric sheets 41 to 44 are easier to handle.

The common electrode 34 is grounded in a non-illustrated region through the FPC 136. Thus, the common electrode 34 is kept at a certain potential (ground potential for example) equally in the region corresponding to every pressure chamber 10. On the other hand, the potentials of the individual electrodes 35 can be controlled independently of one another for the respective pressure chambers 10. For this purpose, the substantially rhombic auxiliary electrode portion 35*b* of each individual electrode 35 is independently in contact with a lead (not illustrated) wired in the FPC 136. The individual electrode 35 is connected with a non-illustrated driver through the lead. Thus, in this embodiment, because the individual electrodes 35 are connected with the FPC 136 at the auxiliary electrode portions 35*b*, outside the pressure chambers 10 in a plan view, expansion and contraction of the actuator unit 21 in its thickness is less hindered. Therefore, the change in volume of each pressure chamber 10 can be increased.

In a modification of this embodiment, many common electrodes 34 each having a shape larger than that of a pressure chamber 10 so that the projection image of each common electrode projected along the thickness direction of the common electrode may include the pressure chamber, may be provided for each pressure chamber 10.

In another modification of this embodiment, many common electrodes 34, each having a shape somewhat smaller than that of a pressure chamber 10 so that the projection image of each common electrode projected along the thickness direction of the common electrode may be included in the pressure chamber, may be provided for each pressure chamber 10.

Thus, in many other embodiments of the invention, the common electrode 34 may not always be a single conductive sheet formed on the whole of the face of a piezoelectric sheet. In the above modifications, however, all the common electrodes must be electrically connected with one another so that the portion corresponding to any pressure chamber 10 may be at the same potential.

In the ink-jet head 1 according to the first embodiment, the piezoelectric sheets 41 to 44 are polarized in their thickness direction. That is, the actuator unit 21 has a so-called unimorph structure in which the uppermost (i.e., the most distant from the pressure chamber 10) piezoelectric sheet 41 includes active layers and the lower (i.e., near the pressure chamber 10) three piezoelectric sheets 42 to 44 are inactive. Therefore, when an individual electrode 35 is set at a positive or negative predetermined potential, if the polarization is in the same direction as the electric field for example, the portion of the piezoelectric sheet 41 sandwiched by the electrodes works as an active layer to contract perpendicularly to the polarization by the transversal piezoelectric effect. On the other hand, since the piezoelectric sheets 42 to 44 are not influenced by an electric field, they do not contract. Thus, a difference in strain perpendicular to the polarization is produced between the uppermost piezoelectric sheet 41 and the lower piezoelectric sheets 42 to 44. As a result, the whole of the piezoelectric sheets 41 to 44 is ready to deform into a convex shape toward the non-active side (unimorph deformation). At this time, as illustrated in FIG. 9, because the lowermost face of the piezoelectric sheets 41 to 44 is fixed to the upper face of the partition (the cavity plate) 22 defining the pressure chamber, the piezoelectric sheets 41 to 44 deform into a convex shape toward the pressure chamber side. Therefore, the volume of the pressure chamber 10 is decreased to increase the pressure of ink. The ink is thereby ejected through the ink ejection port 8. Afterwards, when the individual electrode 35 is returned to the same potential as that of the common electrode 34, the piezoelectric sheets 41 to 44 return to the original shape and the pressure chamber 10 also returns to its original volume. Thus, the pressure chamber 10 sucks ink therein through the manifold channel 5.

In another driving method, all the individual electrodes 35 are set in advance at a different potential from that of the common electrode 34. When an ejecting request is issued, the corresponding individual electrode 35 is set at the same potential as that of the common electrode 34. After this, at a predetermined timing, the individual electrode 35 is again set at the different potential from that of the common electrode 34. In this case, at the point in time when the individual electrode 35 is set at the same potential as that of the common electrode 34, the piezoelectric sheets 41 to 44 return to their original shapes. The corresponding pressure chamber 10 is thereby increased in volume from its initial state (the state that the potentials of both electrodes differ from each other), to suck ink from the manifold channel 5 into the pressure chamber 10. Then, at the point in time when the individual electrode 35 is again set at the different potential from that of the common electrode 34, the piezoelectric sheets 41 to 44 deform into a convex shape toward the pressure chamber 10. The volume of the pressure chamber 10 is thereby decreased and the pressure of ink in the pressure chamber 10 increases to eject ink.

Alternatively, in case that the polarization of piezoelectric sheets 41 to 44 occurs in the reverse direction to the electric field applied to the piezoelectric sheets 41 to 44, the active layer in the piezoelectric sheet 41 sandwiched by the individual electrode 35 and the common electrode 34 is ready to elongate perpendicularly to the polarization by the transversal piezoelectric effect. As a result, the piezoelectric sheets 41 to 44 deform into a concave shape toward the pressure chamber 10. Therefore, the volume of the pressure chamber 10 is increased to suck ink from the manifold channel 5. After this, when the individual electrode 35 returns to its original potential, the piezoelectric sheets 41 to 44 also return to their original flat shape. The pressure chamber 10 thereby returns to its original volume to eject ink through the ink ejection port 8.

In the ink-jet head 1, according to the first embodiment, one ink ejection port 8 communicates with two pressure chambers 10. Therefore, by driving the individual electrodes 35 of the actuator unit 21 corresponding to the respective pressure chambers 10 so that ink is discharged at the same time from the two pressure chambers 10 to the ink ejection port 8, the ink ejection amount through the ink ejection port 8 is the sum of those from the two pressure chambers 10. As a result, if the ink amount to be discharged from each pressure chamber 10 is set at half the conventional value, by lowering the driving voltage, a sufficient ink ejection amount can be ensured. That is, according to this embodiment, in comparison with an ink-jet head in which one ink ejection port 8 communicates with only one pressure chamber 10, the driving voltage for each individual electrode 35 can be considerably lowered. Lowering the driving voltage for each individual electrode 35 can bring about a reduction of power consumption. This makes it possible to use a driver IC small in size and at a low manufacturing cost for driving the individual electrodes 35.

In particular, in case that the actuator unit 21 is disposed to extend over pressure chambers 10, if the unimorph deformation in one of the pressure chambers 10 is intended to be increased, more mechanical resistance is received from the surrounding portion. Thus, the relation is not linear between the voltage to be applied to the individual electrode corresponding to the pressure chamber 10 and the deformation of the pressure chamber 10. That is, the voltage for increasing a deformation of the pressure chamber 10 in a region in which the deformation from the initial state is large is required to be higher than that in a region in which the deformation from the initial state is small. In the first embodiment, however, the ink discharge amount from each pressure chamber can be substantially the half of that in which one ink ejection port 8 communicates with only one pressure chamber. Thus, the unimorph deformation in each pressure chamber 10 may be relatively small. Therefore, driving can be performed in a region in which the deformation from the initial state is little, and the reduction of the driving voltage can be more than half. As a result, the power consumption and the cost of the driver IC are decreased.

The driving voltage for each individual electrode 35 can be lowered further as the number of pressure chambers 10 communicating with one ink ejection port 8 increases. However, the increase in the number of pressure chambers 10 communicating with one ink ejection port 8 may cause a decrease in the number of ink ejection port 8 included in the ink-jet head 1. As a result, the resolution of a printed image may be lowered. Thus, there is a tradeoff relationship between the number of pressure chambers 10 communicating with one ink ejection port 8 and the printed image resolution.

In the ink-jet head 1, according to the first embodiment, the actuator unit 21 includes the piezoelectric sheet 41, including active layers sandwiched by the common electrode 34 common to the pressure chambers 10, and the individual electrodes 35 disposed at positions corresponding to the respective pressure chambers 10. By changing the number of piezoelectric sheets including active layers sandwiched by the common and individual electrodes or the thickness of the active layers, the change in volume of each pressure chamber 10 can be controlled relatively easily.

In the ink-jet head 1, according to the first embodiment, only the piezoelectric sheet 41 most distant from each pressure chamber 10 of the actuator unit 21 includes active layers. Besides, the individual electrodes 35 are formed on only the opposite face (upper face) to the face on the pressure chamber 10 side. Therefore, when the actuator unit 21 is manufactured, no through hole must be formed for interconnecting the individual electrodes disposed so as to overlap each other in a plan view. Thus, the manufacture is easy.

In the passage unit 4, since many pressure chambers 10 neighboring each other are arranged in a matrix, the many pressure chambers 10 can be arranged at a high density within a relatively small region.

Because each pressure chamber 10 has a rhombic shape in a plan view, many pressure chambers 10 can be arranged close to each other, while ensuring a sufficient length in the pressure wave propagation direction of each pressure chamber.

In the ink-jet head 1 according to the first embodiment, three piezoelectric sheets 42 to 44, as non-active layers, are disposed between the piezoelectric sheet 41, including active layers (most distant from each pressure chamber 10, and the passage unit 4). By thus providing three non-active layers for one active layer, the change in volume of each pressure chamber 10 can be relatively increased. As a result, with lowering the driving voltage for the individual electrodes 35, a decrease in size of each pressure chamber and a high integration of the pressure chambers 10 can be realized. This has been confirmed by the inventor of the present invention.

In the ink-jet head 1 according to the first embodiment, constructed as described above, by sandwiching the piezoelectric sheet 41 between the common electrode 34 and the individual electrodes 35, the volume of each pressure chamber 10 can be easily changed by the piezoelectric effect. Besides, since the piezoelectric sheet 41 including active layers is in a shape of a continuous flat layer, it can be easily manufactured.

The ink-jet head 1, according to the first embodiment, has the actuator units 21 each having a unimorph structure in which the piezoelectric sheets 42 to 44 near each pressure chamber 10 are inactive and the piezoelectric sheet 41 distant from each pressure chamber 10 includes active layers. Therefore, the change in volume of each pressure chamber 10 can be increased by the transversal piezoelectric effect. As a result, in comparison with an ink-jet head in which a layer including active layers is provided on the pressure chamber 10 side, and a non-active layer is provided on the opposite side, lowering the voltage to be applied to each individual electrode 35 and/or high integration of the pressure chambers 10 can be realized. By lowering the voltage to be applied, the driver for driving the individual electrodes 35 can be made small in size, holding the cost down. In addition, each pressure chamber 10 can be made small in size. So, even in case of a high integration of the pressure chambers 10, a sufficient amount of ink can be ejected. Thus, a decrease in size of the head 1 and a highly dense arrangement of printing dots can be realized.

Returning to FIG. 4, in the ink-jet head 1, according to the first embodiment, separate actuator units 21 corresponding to the respective ink ejection regions are bonded onto the passage unit 4 to be arranged along the longitudinal direction of the passage unit 4. Therefore, each of the actuator units 21, apt to be uneven in dimensional accuracy and in positional accuracy of the individual electrodes 35, because they are formed by sintering or the like, can be positioned on the passage unit 4 independently of another actuator unit 21. Thus, even in case of a long ink-jet head, the increase in shift of each actuator unit 21 from the accurate position on the passage unit 4 is restricted, and each actuator unit 21 can accurately be positioned relative to one another. Therefore, the manufacture yield of the ink-jet heads 1 is remarkably improved.

Further, in the ink-jet head 1, according to the first embodiment, each actuator unit 21 has a substantially trapezoidal shape. The actuator units 21 are arranged in two lines in a zigzag manner so that the parallel opposed sides of each actuator unit 21 extend along the longitudinal direction of the passage unit 4, and the oblique sides of each neighboring actuator units 21 overlap each other in the lateral direction of the passage unit 4. Because the oblique sides of each neighboring actuator units 21 overlap each other, when the ink-jet head 1 moves along the lateral direction of the ink-jet head 1 relative to an image recording medium, the pressure chambers 10 existing along the lateral direction of the passage unit 4 can compensate each other. As a result, while realizing high-resolution printing, a small-size ink-jet head 1 having a very narrow width can be realized.

Next, a manufacturing method of the head main body 1*a* of the ink-jet head 1 will be described. To fabricate an actuator unit 21, first, four ceramic green sheets, to become piezoelectric sheets 41 to 44, are put in layers and then baked. Upon being put in layers, on each of the ceramic material, a pattern of a metallic material is printed to become either a common electrode 34 or reinforcement metallic films 36*a* or 36*b*. After baking, a metallic material to become individual electrodes 35 is plated on the whole upper face of the piezoelectric sheet 41, and then the unnecessary portion of the metallic material is removed by a laser patterning technique. Alternatively, the metallic material to be the individual electrodes 35 may be formed on the piezoelectric sheet 41 by vapor deposition using a mask having openings at positions corresponding to the respective individual electrodes 35.

Thus, in contrast to the other electrodes, the individual electrodes 35 are not baked together with the ceramic materials to become the piezoelectric sheets 41 to 44. Thus, there is no possibility that the individual electrodes 35 externally exposed may evaporate at the high temperature encountered during baking. Because the individual electrodes 35 are formed by the above-described technique after baking, they can be formed into a relatively small thickness. Thus, in the ink jet head 1 according to the first embodiment, by forming the individual electrodes 35 in the uppermost layer into a small thickness, the deformation of the piezoelectric sheet 41 including active layers is less likely to be resisted by the individual electrodes 35. As a result of the electrodes 35 small thickness, efficiencies (electrical efficiency and area efficiency) of the actuator unit 21 are improved.

Moreover, considering the evaporation upon baking as mentioned above, it may be possible to print a pattern of the individual electrodes, made of metal paste, and then bake the individual electrodes 35, after the piezoelectric sheets 41 to 44 are baked. In this case, because the piezoelectric sheets 41 to 44 have already been adequately contracted while being baked, the dimension of the piezoelectric sheets 41 to 44 are hardly varied by contraction when the individual electrodes are baked. Therefore, the individual electrodes 35 and the corresponding pressure chambers 10 can be aligned with good accuracy.

As mentioned above, the providing of the reinforcement metallic films 36*a* and 36*b* can reinforce the brittleness of the piezoelectric sheets 41 to 44, thereby improving the handling of piezoelectric sheets 41 to 44. However, it is not always necessary to provide the reinforcement metallic films 36*a* and 36*b*. For example, when the size of the actuator unit 21 is approximately 1 inch, the handling ability of the piezoelectric sheets 41 to 44 is not damaged by brittleness even if the reinforcement metallic films 36*a* and 36*b* are not provided.

Further, according to this first embodiment, the individual electrodes 35 are formed only on the piezoelectric sheet 41, as described above. On the other hand, when the individual electrodes are also formed on the other piezoelectric sheets 42 to 44, the individual electrodes have to be printed on the desired piezoelectric sheets 41 to 44 before laminating and baking the piezoelectric sheets 41 to 44. Accordingly, the contraction of piezoelectric sheets 41 to 44 in baking causes a difference between the positional accuracy of the individual electrodes on the piezoelectric sheets 42 to 44 and the positional accuracy of the individual electrodes 35 on the piezoelectric sheet 41. According to this first embodiment, however, because the individual electrodes are formed only on the piezoelectric sheet 41, such a difference in positional accuracy is not caused and the individual electrodes 35 and the corresponding pressure chambers 10 are aligned with good accuracy.

The actuator unit 21 fabricated as described above is bonded to a passage unit 4 with an adhesive. The passage unit 4 is separately fabricated by bonding eight metallic plates of a cavity plate 22 in which a large number of openings have been formed by etching, and so on. When the actuator unit 21 is bonded to the passage unit 4, positioning marks provided on the respective surfaces of the cavity plate 22 of the passage unit 4 and the piezoelectric sheet 41 of the actuator unit 21 are aligned to each other.

An FPC 136, for supplying electric signals to the respective individual electrodes 35, is then bonded onto and electrically connected with the actuator unit 21 by soldering. After this, through a predetermined process, the manufacture of the ink-jet head 1 is completed.

In the actuator unit 21, according to the first embodiment, because the piezoelectric sheet 41, including active layers, and the piezoelectric sheets 42 to 44, as the non-active layers, are made of the same material, the material need not be changed in the manufacturing process. Thus, they can be manufactured through a relatively simple process, and a reduction of manufacturing cost is expected. Because, each of the piezoelectric sheet 41, including active layers, and the piezoelectric sheets 42 to 44, as the non-active layers, has substantially the same thickness, a further reduction of cost can be expected due to the simplification of the manufacturing process. This is because the thickness control can easily be performed when the ceramic materials to be the piezoelectric sheets are applied to be put in layers.

Figure 11A:
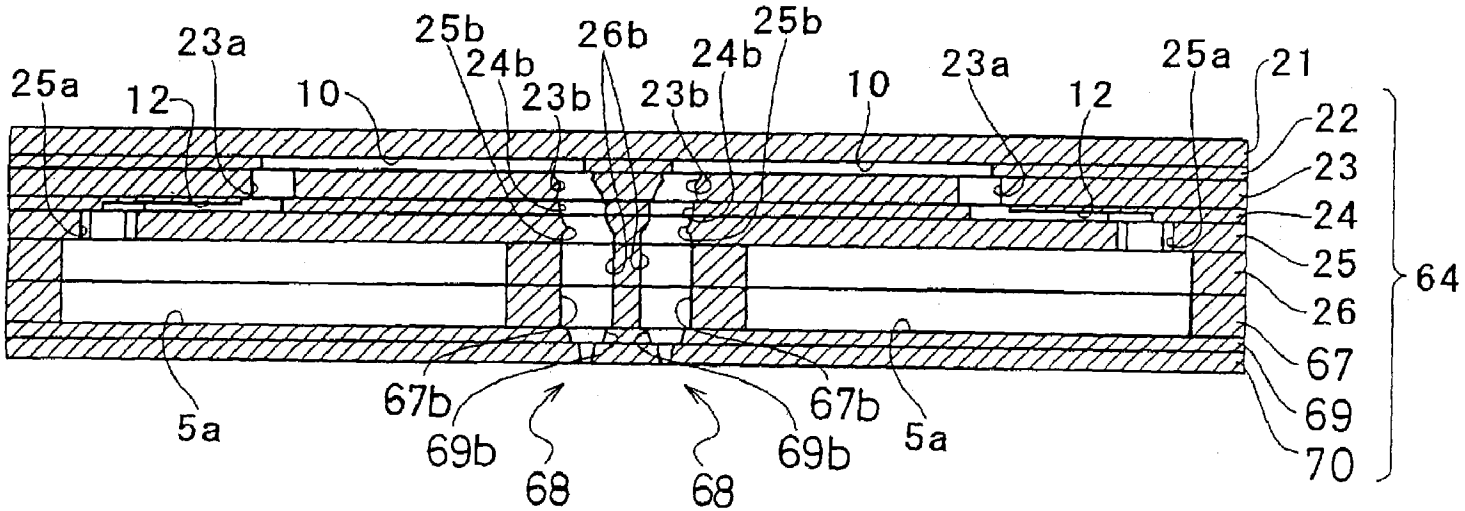
FIG. 11A is a partial sectional view corresponding to FIG. 7A, though part of the components of the ink-jet head of FIG. 3 has been changed.
Figure 11B:
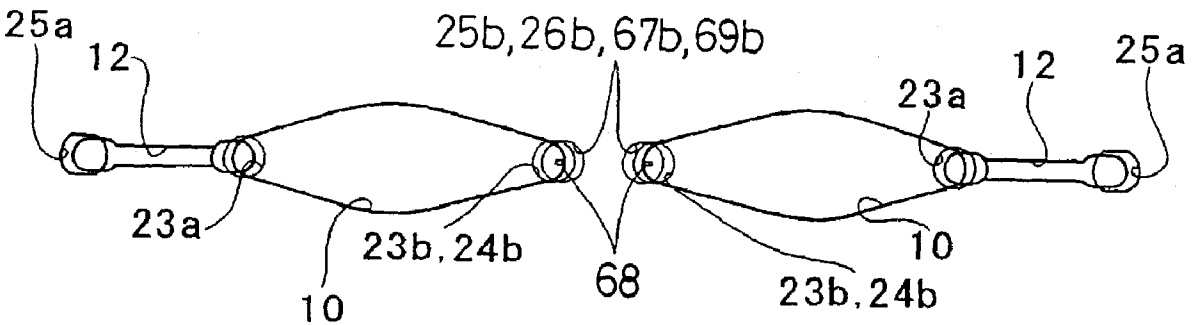
FIG. 11B is a see-through plan view of the principal portion corresponding to FIG. 7B, though the part of the components of the ink-jet head of FIG. 3 has been changed.
Figure 12:
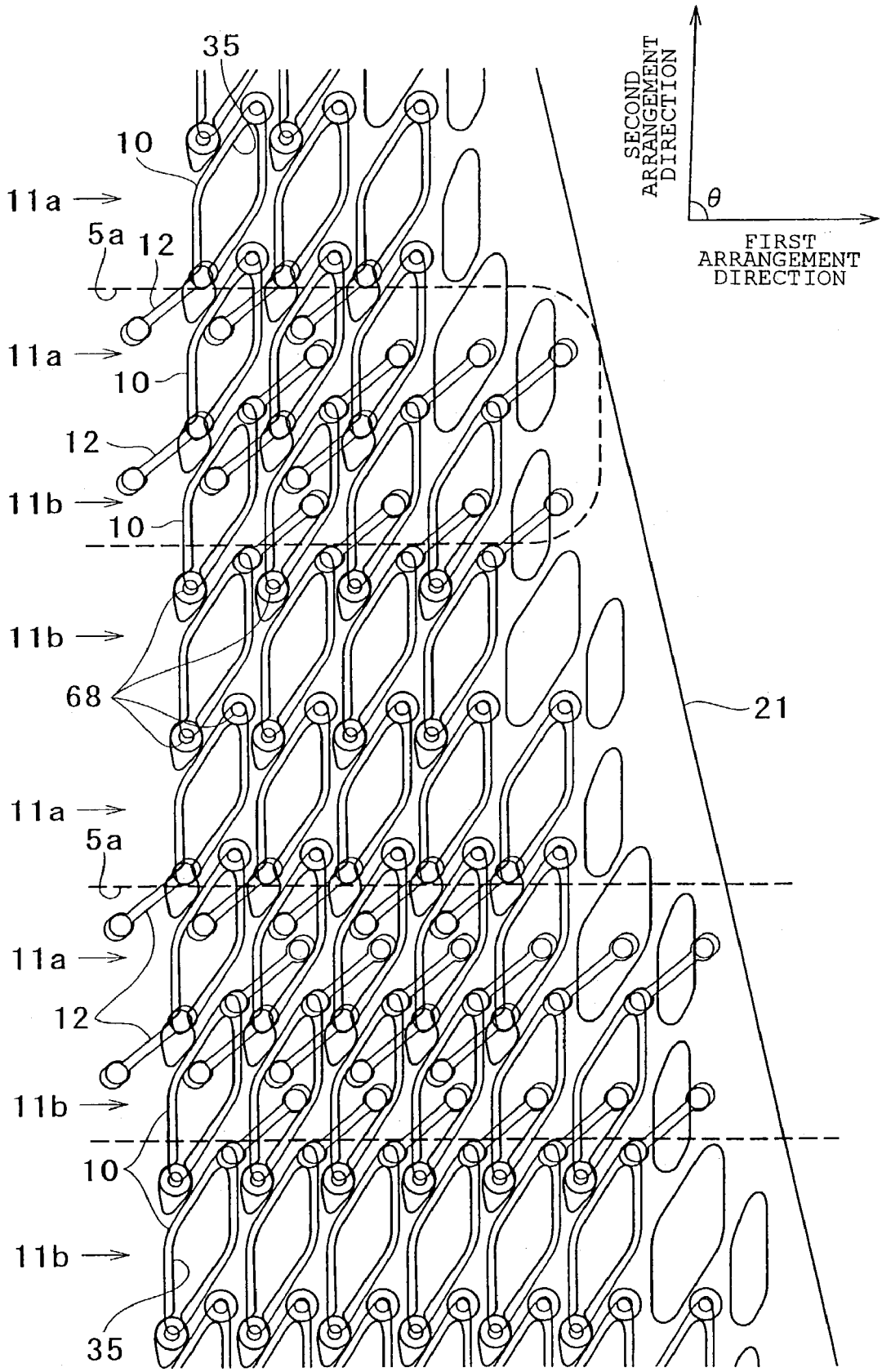
FIG. 12 is a view corresponding to FIG. 6 of the ink jet head of FIGS. 11A and 11B.

As described above, in the ink-jet head 1 according to the first embodiment, the passage unit 4 is laminated with eight plates 22 to 30. Therefore, only by changing part of the eight plates 22 to 30, a state in which one ink ejection port 8 communicates with only one pressure chamber 10 can easily be exchanged with a state in which one ink-jet port 8 communicates with two or more pressure chambers 10. This feature will be described in more detail with reference to FIGS. 11A, 11B, and 12. FIGS. 11A and 11B are a partial sectional view and a see-through plan view of a principal portion corresponding to FIGS. 7A and 7B respectively, where each ink ejection port 8 communicates with only one pressure chamber 10. FIG. 12 is a plan view corresponding to FIG. 6. In FIGS. 11A, 11B, and 12, the same components as those in FIGS. 6, 7A, and 7B are denoted by the same reference numerals as those in FIGS. 6, 7A, and 7B, respectively.

As apparent when comparing FIGS. 7A and 11A with each other, a passage unit 64 illustrated in FIG. 11A is constructed by replacing the manifold plate 7, the cover plate 29, and the nozzle plate 30 of the passage unit 4, illustrated in FIG. 7A, by a manifold plate 67, a cover plate 69, and a nozzle plate 70, respectively. The remaining plates 22 to 26 are the same in both cases.

Referring to FIGS. 11A and 11B, the manifold plate 67, made of metal, defines a lower portion of each manifold channel 5*a*. In the manifold plate 67, a communication hole 67*b*, formed at the same position and into the same shape as the communication hole 26*b* of the manifold plate 26, is provided to correspond to each pressure chamber 10 of the cavity plate 22. In the cover plate 69, also made of metal, a communication hole 69*b*, continuous from the communication holes 23*b*, 24*b*, 25*b*, 26*b*, and 67*b*, to communicate with an ink ejection port 68 is provided to correspond to each pressure chamber 10. In the nozzle plate 70, made of metal, a tapered ink ejection port 68 to function as a nozzle communicating with each pressure chamber 10 through the communication holes 23*b*, 24*b*, 25*b*, 26*b*, 67*b*, and 69*b*, is provided to correspond to each pressure chamber 10.

Thus, in case of the ink-jet head having the passage unit 64, illustrated in FIGS. 11A, 11B, and 12, one ink ejection port 68 communicates with only one pressure chamber 10. The ink ejection port 68 is provided at a position corresponding to an end of the pressure chamber 10. Therefore, the number of ink ejection ports 68 is double of that of the ink-jet head 1 (with two pressure chambers 10 for each ink ejection port 8) according to this first embodiment. Therefore, this printer can perform printing at 600 dpi in the main scanning direction.

The passage unit 64, illustrated in FIGS. 11A, 11B, and 12, can be obtained by replacing only three plates of the passage unit 4 according to the first embodiment. Therefore, it can be relatively easily fabricated. Thus, according to this embodiment, both a head capable of printing a high-resolution image and a head capable of printing a low-resolution image by low-voltage driving can be realized with many of the same components.

Figure 13A:
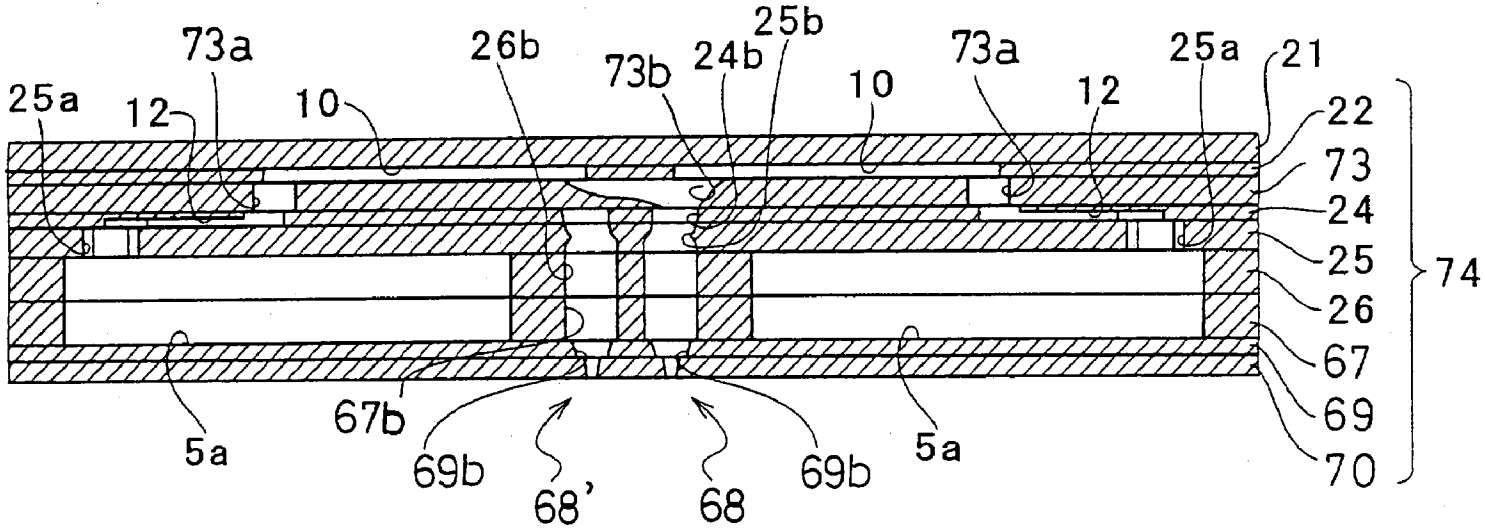
FIG. 13A is a partial sectional view of an ink-jet head according to a second embodiment of the present invention, corresponding to FIG. 7A.
Figure 13B:
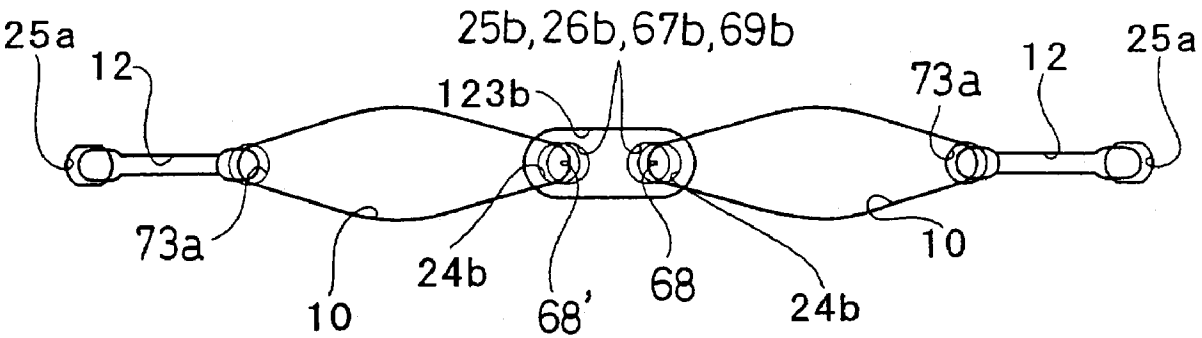
FIG. 13B is a see-through plan view of a principal portion of the ink-jet head according to the second embodiment of the present invention, corresponding to FIG. 7B.

Next, a second embodiment of the present invention will be described. FIGS. 13A and 13B are a partial sectional view and a see-through plan view of a principal portion of an ink-jet head according to this second embodiment, corresponding to FIGS. 7A and 7B, respectively. In FIGS. 13A and 13B, the same components as those in FIGS. 7A, 7B, 11A, and 11B are denoted by the same reference numerals as those in FIGS. 7A, 7B, 11A, and 11B, respectively.

As is apparent when comparing FIGS. 13A and 11A with each other, a passage unit 74, illustrated in FIG. 13A, is constructed by replacing the base plate 23 of the passage unit 64 illustrated in FIG. 11A by a base plate 73. The remaining plates 22, 24 to 26, 67, 69, and 70 are used in common in both cases.

Referring to FIGS. 13A and 13B, in the base plate, 73 made of metal, a communication hole 73*a* is provided for each pressure chamber 10 to connect the pressure chamber 10 with the corresponding aperture 12. Also, in the base plate 73, a slender communication hole 73*b* is provided to connect two pressure chambers 10, neighboring along the longer diagonal of each pressure chamber 10, with one communication hole 24*b*. By the provision of the communication hole 73*b* in the base plate 73, one ink ejection port 68 communicating with the communication hole 73*b* is supplied with ink from the two pressure chambers 10. But, the other ink ejection port 68' not communicating with the communication hole 73*b* is supplied with no ink. That is, the ink ejection port 68' is a "dummy".

Thus, in the ink-jet head according to the second embodiment illustrated in FIGS. 13A and 13B, one ink ejection port 68 also communicates with two pressure chambers 10, like the above-described first embodiment. Therefore, the driving voltage for the individual electrodes 35 can be lowered. In the ink-jet head according to the second embodiment, by replacing only base plate 73, a state in which printing can be performed at a low resolution of 300 dpi can be changed into a state in which printing can be performed at a high resolution of 600 dpi. The second embodiment is advantageous in that more of the same components can be used for the two resolutions when compared with the first embodiment.

In addition, in the second embodiment, the flows of ink from two ink passages join within the base plate 73, which is the closest to the pressure chambers 10 and relatively apart from the ink ejection port 68. Therefore, disturbance of ink flow, which can be produced upon the two ink flows joining, may have less of a negative influence upon the ink ejection performance through the ink ejection port 68. This is also advantageous.

In the above-described embodiments, the materials of the piezoelectric sheets and electrodes are not limited to the above-described materials and can be changed to other known materials. The shape in a plan or sectional view of each pressure chamber, the arrangement of the pressure chambers, the number of piezoelectric sheets including active layers, and the number of non-active layers can be changed properly. For example, only one slender actuator unit may be bonded onto the passage unit. Furthermore, the piezoelectric sheet including active layers may differ in thickness from the non-active layer.

In the above-described embodiments, one ink ejection port communicates with two pressure chambers. But, one ink ejection port may communicate with three or more pressure chambers as well.

In the above-described embodiments, only the uppermost piezoelectric sheet most distant from the pressure chambers includes active layers. But, one or some of the other piezoelectric sheets may also include active layers. To manufacture such an ink-jet head, when piezoelectric sheets are put in layers, a pattern of individual electrodes is printed on one face of each of the piezoelectric sheets to include active layers (on the lower face of the piezoelectric sheet 42 for example). In this case, however, through holes must be formed to interconnect individual electrodes vertically overlapping each other in a plan view. Thus, the manufacturing process is somewhat complicated.

Also, in the above-described embodiments, individual electrodes and a common electrode are disposed on a piezoelectric sheet to form an actuator unit. But, the actuator unit is not limited to this type. Any other type of actuator unit can be used if it can change the volume of each pressure chamber separately.

Further, in the above-described embodiments, the passage unit is laminated with sheet-like metallic plates bonded to each other. But, the passage unit may not be laminated with such sheet members. Besides, even in case of the passage unit laminated with sheet members, it can be designed for the flows of ink from ink passages to join within any plate.

Additionally, in the above-described embodiments, trapezoidal actuator units are arranged in two lines in a zigzag manner. But, each actuator unit may not be trapezoidal. The actuator units may be arranged in only one line along the longitudinal direction of the passage unit. Actuator units may also be arranged in three or more lines in a zigzag manner.

Furthermore, the pressure chambers may not always be arranged in a matrix. Alternatively, the pressure chambers may be arranged in one or more lines.

Finally, in the above described embodiments the non-active layers are made from a piezoelectric sheet. Any of non-active layers may be made of an insulating sheet other than a piezoelectric sheet.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit including a plurality of pressure chambers each having one end connected with a nozzle and the other end to be connected with an ink supply source, the plurality of pressure chambers being arranged along a plane so as to neighbor each other with two or more pressure chambers communicating with one nozzle; and a unimorph type actuator unit fixed to a surface of the passage unit and extending over the pressure chambers for changing the volume of each of the pressure chambers, the actuator comprising an inactive piezoelectric sheet fixed to the surface of the passage unit and extending over the plurality of pressure chambers, wherein the actuator unit comprises:

a common electrode that is common to the plurality of pressure chambers;

a plurality of individual electrodes disposed at positions respectively corresponding to the plurality of pressure chambers; and one or more piezoelectric sheets, each of the one or more piezoelectric sheets extending over the plurality of pressure chambers, and each of the one or more piezoelectric sheets sandwiched by the common electrode and at least one of the individual electrodes; and wherein the inactive piezoelectric sheet does not contact the plurality of individual electrodes.

2. The ink-jet head according to claim 1, wherein the passage unit is laminated with a plurality of sheet members.

3. The ink-jet head according to claim 1, wherein the passage unit comprises:

a cavity plate for defining the plurality of pressure chambers;

a nozzle plate in which a plurality of nozzles are formed; and a connection plate in which an interconnecting passage for connecting one nozzle with two or more pressure chambers is formed, the connection plate comprising one sheet member or two or more sheet members in layers.

4. The ink-jet head according to claim 3, wherein at least one of the one or more of the sheet members of the connection plate and the nozzle plate can be replaced to change a state in which one nozzle communicates with two or more pressure chambers, into a state in which one nozzle communicates with only one pressure chamber.

5. The ink-jet head according to claim 1, wherein each of the pressure chambers has a slender shape, both ends of which are in a plane substantially parallel with the plane and which has a length between the ends longer than a length perpendicular to the length.

6. The ink-jet head according to claim 1, wherein the plurality of pressure chambers are arranged in a matrix neighboring each other.

7. The ink-jet head according to claim 1, wherein each of the pressure chambers has a rhombic shape in a plan view.

8. The ink-jet head according to claim 1, wherein a plurality of actuator units are arranged along the longitudinal direction of the passage unit.

9. An ink-jet printer comprising an ink-jet head, the ink-jet head comprising:

a passage unit including a plurality of pressure chambers each having one end connected with a nozzle and the other end to be connected with an ink supply source, the pressure chambers being arranged along a plane so as to neighbor each other, two or more pressure chambers communicating with one nozzle; and a unimorph type actuator unit fixed to a surface of the passage unit and extending over the pressure chambers for changing the volume of each of the pressure chambers, the actuator comprising an inactive piezoelectric sheet fixed to the surface of the passage unit and extending over the plurality of pressure chambers, wherein the actuator unit comprises:

a common electrode that is common to the plurality of pressure chambers;

a plurality of individual electrodes disposed at positions respectively corresponding to the plurality of pressure chambers; and one or more piezoelectric sheets, each of the one or more piezoelectric sheets extending over the pressure chambers, each of the one or more piezoelectric sheets sandwiched by the common electrode and at least one of the individual electrodes; and wherein the inactive piezoelectric sheet does not contact the plurality of individual electrodes.

10. An ink-jet head comprising:

a passage unit including a plurality of pressure chambers each having one end connected with a nozzle and the other end to be connected with an ink supply source, the plurality of pressure chambers being arranged along a plane so as to neighbor each other with two or more pressure chambers communicating with one nozzle;

a driver that supplies an amount of power to each of two or more individual electrodes corresponding to the two or more pressure chambers communicating with one nozzle to eject ink from the one nozzle, a total of the amount of power supplied being less than an amount of power required to be applied to less than all of the two or more pressure chambers connected to the nozzle to eject a same amount of ink; and an actuator unit fixed to a surface of the passage unit and extending over the pressure chambers for changing the volume of each of the pressure chambers, wherein the actuator unit comprises:

a common electrode that is common to the plurality of pressure chambers;

a plurality of individual electrodes disposed at positions respectively corresponding to the plurality of pressure chambers; and one or more piezoelectric sheets, each of the one or more piezoelectric sheets extending over the plurality of pressure chambers, and each of the one or more piezoelectric sheets sandwiched by the common electrode and at least one of the individual electrodes.

11. An ink-jet printer comprising an ink-jet head, the ink-jet head comprising:

passage unit including a plurality of pressure chambers each having one end connected with a nozzle and the other end to be connected with an ink supply source, the pressure chambers being arranged along a plane so as to neighbor each other, two or more pressure chambers communicating with one nozzle;

a driver that supplies an amount of power to each of two or more individual electrodes corresponding to the two or more pressure chambers communicating with one nozzle to eject ink from the one nozzle, a total of the amount of power supplied being less than an amount of power required to be applied to less than all of the two or more pressure chambers connected to the nozzle to eject a same amount of ink; and an actuator unit fixed to a surface of the passage unit and extending over the pressure chambers for changing the volume of each of the pressure chambers, wherein the actuator unit comprises:

a common electrode that is common to the plurality of pressure chambers;

a plurality of individual electrodes disposed at positions respectively corresponding to the plurality of pressure chambers; and one or more piezoelectric sheets, each of the one or more piezoelectric sheets extending over the pressure chambers, each of the one or more piezoelectric sheets sandwiched by the common electrode and at least one of the individual electrodes.

* * * * *